US011019939B1

(12) United States Patent
Flannery et al.

(10) Patent No.: US 11,019,939 B1
(45) Date of Patent: Jun. 1, 2021

(54) TRAY WITH INTEGRAL MECHANISM

(71) Applicant: Regalo International, LLC, Longboat Key, FL (US)

(72) Inventors: Mark A. Flannery, Longboat Key, FL (US); William D. Butterfield, River Falls, WI (US)

(73) Assignee: Regalo International, LLC, Longboat Key, FL (US)

( * ) Notice: Subject to any disclaimer, the term of this patent is extended or adjusted under 35 U.S.C. 154(b) by 91 days.

(21) Appl. No.: 16/387,363

(22) Filed: Apr. 17, 2019

Related U.S. Application Data

(60) Provisional application No. 62/661,876, filed on Apr. 24, 2018.

(51) Int. Cl.
*A47D 1/00* (2006.01)
*A47D 15/00* (2006.01)

(52) U.S. Cl.
CPC ..... *A47D 1/0085* (2017.05); *A47D 15/006* (2013.01)

(58) Field of Classification Search
CPC ..... A47D 1/0085
USPC ..... 297/170, 171
See application file for complete search history.

(56) References Cited

U.S. PATENT DOCUMENTS 4,300,798 A * 11/1981 Musgrove ..... A47C 7/664 297/184.15
4,807,928 A * 2/1989 Cone ..... A47B 23/02 297/153
5,238,292 A * 8/1993 Golenz ..... A47D 1/0081 297/153
5,348,374 A * 9/1994 Kuo ..... A47D 1/004 297/344.18
5,823,615 A * 10/1998 Haut ..... A47D 1/0085 297/151
5,865,124 A * 2/1999 Wroe ..... A47C 7/70 108/26
6,193,308 B1 * 2/2001 Hwang ..... A47C 7/624 297/171
6,247,750 B1 * 6/2001 Tsai ..... A47C 4/286 297/16.2
6,419,312 B1 7/2002 Flannery et al.
6,692,070 B1 * 2/2004 Hou ..... A47D 1/00 297/153
7,025,416 B1 * 4/2006 Ramirez ..... A47C 5/00 297/160
7,422,276 B2 9/2008 Flannery
8,661,990 B2 * 3/2014 Crowe ..... A47C 7/70 108/115
8,696,055 B2 * 4/2014 Stolarz ..... A47D 1/0081 297/149
8,864,223 B2 * 10/2014 Larson ..... A47C 7/705 297/44

(Continued)

*Primary Examiner* — David R Dunn
*Assistant Examiner* — Tania Abraham

(57) ABSTRACT

A tray for attachment to first and second rising legs of a foldable chair for a child. A connection between the tray and one of the first and second legs includes a female connector depending from the underside of a tray and a male connector rising from the leg. An interlock slides between the female and male connectors and is operated by a handle integral with the interlock. Resilient arms integral with the interlock and handle keep the interlock engaged and automatically draw back the interlock after the handle slides the interlock to a disengaged position such that the tray can be removed from the legs.

17 Claims, 20 Drawing Sheets

(56) References Cited

U.S. PATENT DOCUMENTS

| | | | | |
|---|---|---|---|---|
| 8,979,190 | B2 * | 3/2015 | Madrigal | A47C 7/622<br>297/162 |
| 9,420,899 | B2 * | 8/2016 | Merlo | A47D 1/0081 |
| 9,565,929 | B2 | 2/2017 | Flannery et al. | |
| 9,955,811 | B2 | 5/2018 | Flannery et al. | |
| 2010/0072790 | A1 * | 3/2010 | Pleiman | A47C 4/286<br>297/45 |

* cited by examiner

FIG. 15A
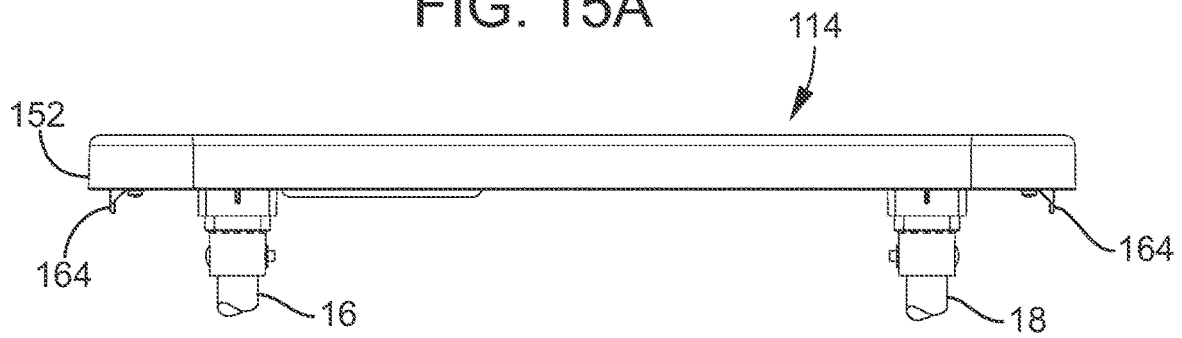
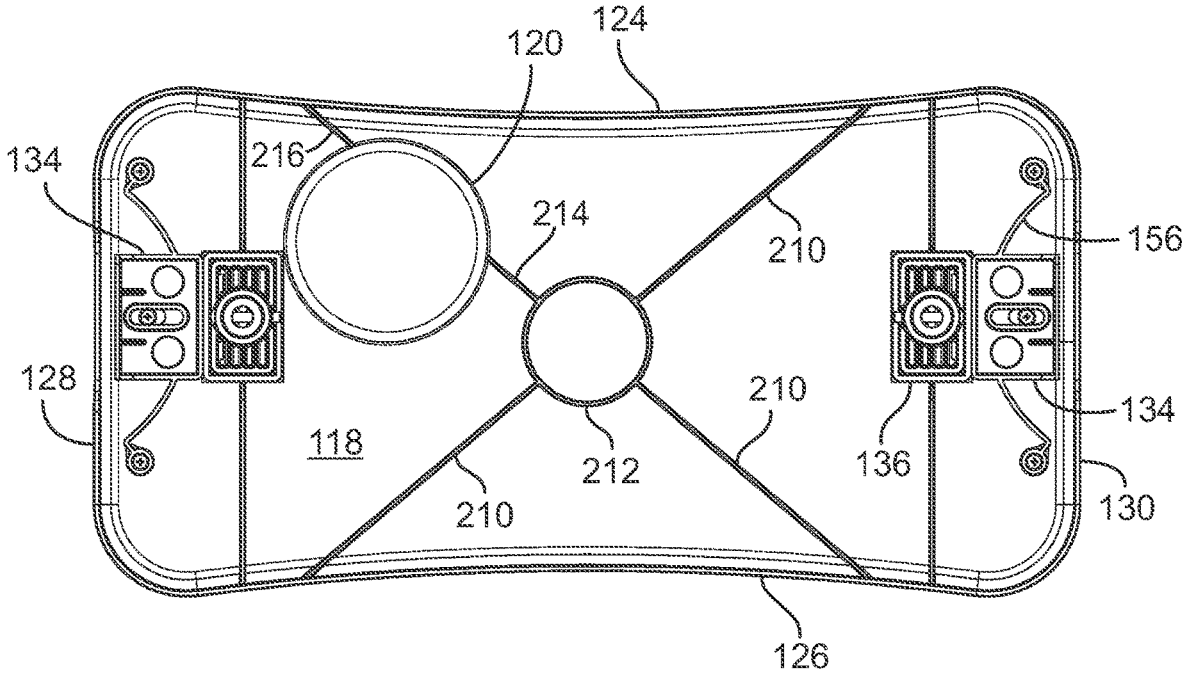
FIG. 15B

TRAY WITH INTEGRAL MECHANISM

This application claims the benefit under 35 U.S.C. 119(e) of U.S. Provisional Patent Application No. 62/661,876 filed Apr. 24, 2018, which application is hereby incorporated by reference in its entirety into this application.

FIELD OF THE INVENTION

The present invention relates to a tray, particularly to a tray for attachment to a foldable chair for a child, and specifically to a connection between the tray and the foldable chair and to an integral tray removing mechanism.

BACKGROUND OF THE INVENTION

Children are strong, perceptive, and persistent. Trays for chairs for children thus are desirably strong, smart, and resistant.

SUMMARY OF THE INVENTION

A feature of the present invention is a tray.

Another feature of the present invention is a tray for a chair.

Another feature of the present invention is a tray for a foldable chair.

Another feature of the present invention is a connection between a tray and the rising legs of a foldable chair.

Another feature of the present invention is the provision in such a connection, of a first connector where the first connector is engaged to the upper portion of the leg.

Another feature of the present invention is the provision in such a connection, of a second connector where the second connector is on the first connector.

Another feature of the present invention is the provision in such a connection, of a third connector where the third connector is on the underside of the tray.

Another feature of the present invention is the provision in such a connection, of an interlock between the second and third connectors.

Another feature of the present invention is the provision in such a connection, of a handle for disengaging the interlock from between the second and third connectors.

Another feature of the present invention is the provision in such a connection, of the handle being one-piece and integral with the interlock.

Another feature of the present invention is the provision in such a connection, of a first resilient arm for keeping the interlock engaged between the second and third connectors and for automatically drawing the interlock back to an engaged position between the second and third connectors after the handle has been operated to disengage the interlock from between the second and third connectors.

Another feature of the present invention is the provision in such a connection, of the first resilient arm being one-piece and integral with the handle and the interlock Another feature of the present invention is the provision in such a connection, of the first resilient arm being engaged to the underside of the tray.

Another feature of the present invention is the provision in such a connection, of the first connector being a female connector.

Another feature of the present invention is the provision in such a connection, of the first connector being cylindrical and receiving the upper portion of the leg therein.

Another feature of the present invention is the provision in such a connection, of the second connector being a male connector.

Another feature of the present invention is the provision in such a connection, of the third connector being a female connector.

Another feature of the present invention is the provision in such a connection, of one of the second and third connectors being a male connector and of the other of the second and third connectors being a female connector.

Another feature of the present invention is the provision in such a connection, of each of the second and third connectors including first, second, third, and fourth sides, where the first sides abut each other, where the second sides abut each other, where the third sides abut each other, and where the fourth sides abut each other such that side to side movement of the leg relative to the tray is minimized and such that front to rear movement of the leg relative to the tray is minimized.

Another feature of the present invention is the provision in such a connection, of a second resilient arm, where the handle includes a body, where the body includes a first side and a second side, where the first resilient arm extends from the first side of the body, and where the second resilient arm extends from the second side of the body.

Another feature of the present invention is the provision in such a connection, of the tray including a peripheral lip, where the peripheral lip defines a plane that separates an inside of the tray from an outside of the tray, and where the handle is on the inside of the tray and spaced from the plane when the interlock is engaged between the second and third connectors.

Another feature of the present invention is the provision in such a connection, of the tray including a peripheral lip, where the peripheral lip defines a plane that separates an inside of the tray from an outside of the tray, and where the handle is adjacent to the plane when the interlock is disengaged from between the second and third connectors.

Another feature of the present invention is the provision in such a connection, of a stop, where the stop depends from the underside of the tray, where the handle includes a body, where the body includes a slot having an inner end and an outer end, where the interlock is engaged between the second and third connectors when the stop abuts the inner end of the slot, and where the interlock is disengaged between the second and third connectors when the stop abuts the outer end of the slot.

Another feature of the present invention is the provision in such a connection, of an interlock in the connection between the tray and the leg of the chair, where the tray is locked to the chair when the interlock is in an engaged position, and where the tray is removable from the chair when the interlock is in a disengaged position.

Another feature of the present invention is the provision in such a connection, of a handle for sliding the interlock from the engaged position to the disengaged position.

Another feature of the present invention is the provision in such a connection, of a body between the handle and the interlock, where the handle and the interlock are integral and one-piece with the body, and where the body includes first and second sides.

Another feature of the present invention is the provision in such a connection, of first and second resilient arms for keeping the interlock in the engaged position and for automatically drawing the interlock back to the engaged position after the handle has been operated to slide the interlock from the engaged position to the disengaged position, where the first resilient arm extends from the first side of the body and is engaged to the tray, where the second resilient arm extends from the second side of the body and is engaged to the tray, and where the first and second resilient arms are one-piece and integral with the body.

Another feature of the present invention is the provision in such a connection, of the connection including a first piece depending from the tray, of the connection including a second piece rising from the leg, and of the interlock sliding into each of the first and second pieces.

Another feature of the present invention is the provision in such a connection, of an interlock in the connection between the tray and the leg of the chair, where the tray is locked to the chair when the interlock is in an engaged position, where the tray is removable from the chair when the interlock is in a disengaged position, and of a handle for sliding the interlock from the engaged position to the disengaged position, where the handle is on the inside of the tray and spaced from a plane defined by the peripheral lip when the interlock is in the engaged position, and where the handle is adjacent to such plane when the interlock is in the disengaged position.

Another feature of the present invention is the provision in such a connection, of the handle being one-piece and integral with the interlock.

Another feature of the present invention is the provision in such a connection, of the peripheral lip of the tray having an opening adjacent to the handle such that the handle is visible to a caregiver.

An advantage of the present invention is that the handle moves a minimum distance for unlocking the interlock mechanism and thus for removing the tray.

Another advantage of the present invention is that the handle moves a minimum distance from the unlocked position to the locked position for locking the tray to the chair.

Another advantage of the present invention is that in the locked position the handle is tucked in the inside of the tray and is spaced from a plane defining a lip of the tray.

Another advantage of the present invention is that the handle is adjacent to a plane defining a periphery of the tray when the interlock is in a disengaged position.

Another advantage of the present invention is that the bottom of the tray is exposed such that the locking mechanism is accessible for cleaning.

Another advantage of the present invention is that tray movement, such as a rocking movement, side to side movement, or forward and back movement, is minimal when the tray is engaged to the legs. Features contributing to this advantage are the inclusion of a box like female connector depending from the underside of the tray and the inclusion of a box like male connector rising from a respective leg of the chair.

Another advantage is that the lock/unlock mechanism is strong. One feature contributing to this advantage is that the interlock is integral with a body of the handle and that resilient arms that keep the interlock in a normal locked position are integral with such body and therefore also integral with the interlock and the handle.

Another advantage of the present invention is that the lock/unlock mechanism is easy to use.

Another advantage of the present invention is that the lock/unlock mechanism is inexpensive to manufacture. One feature contributing to this advantage is that the handle, interlock, and first and second resilient arms are one-piece and integral with each other.

BRIEF DESCRIPTION OF THE DRAWINGS

FIG. 15A is a side view of the tray of FIG. 11.

FIG. 15B is a bottom view of the tray of FIG. 11.

DESCRIPTION

Figure 1:
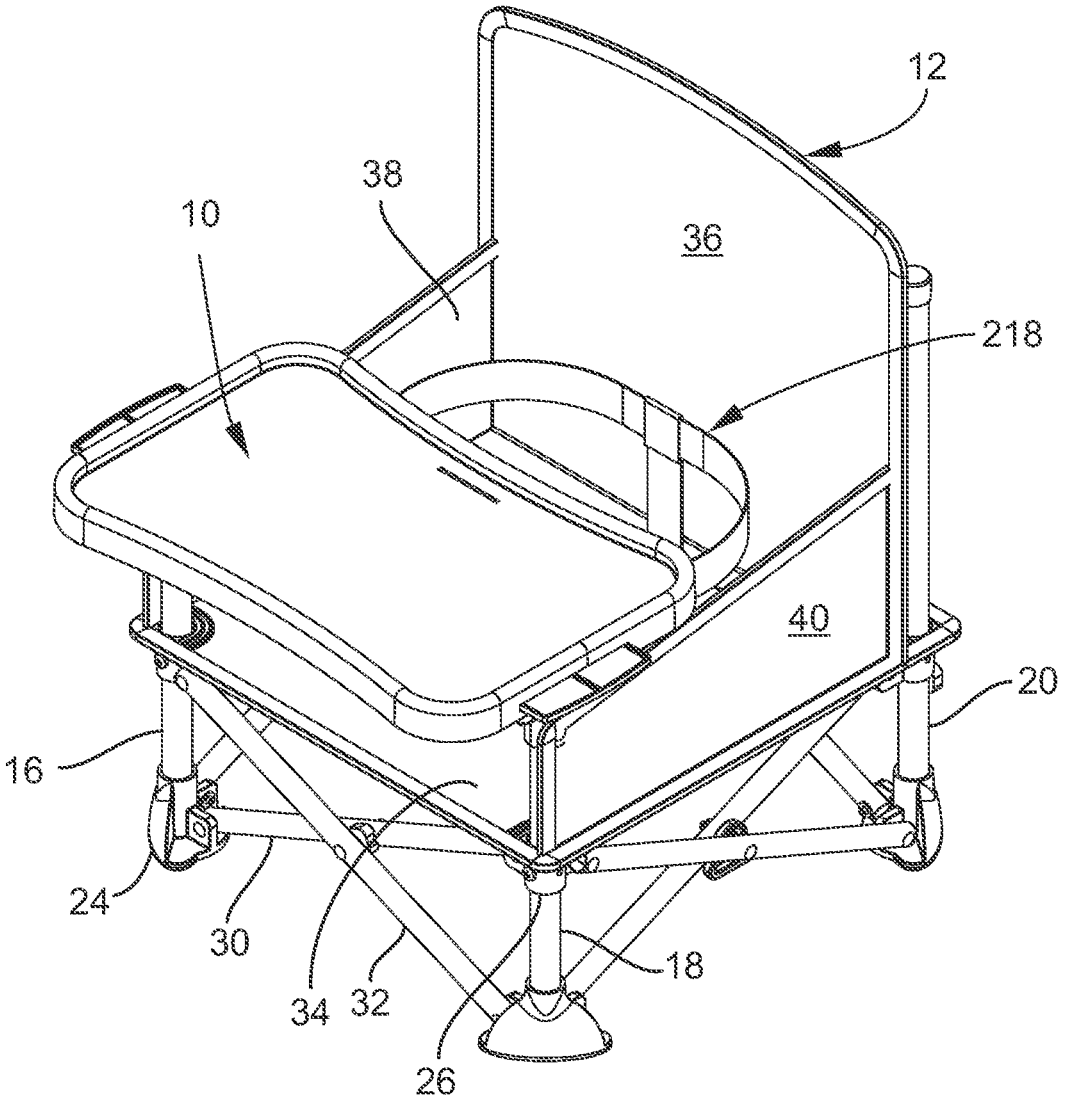
FIG. 1 is a perspective view of a folding chair having the present tray.
Figure 2A:
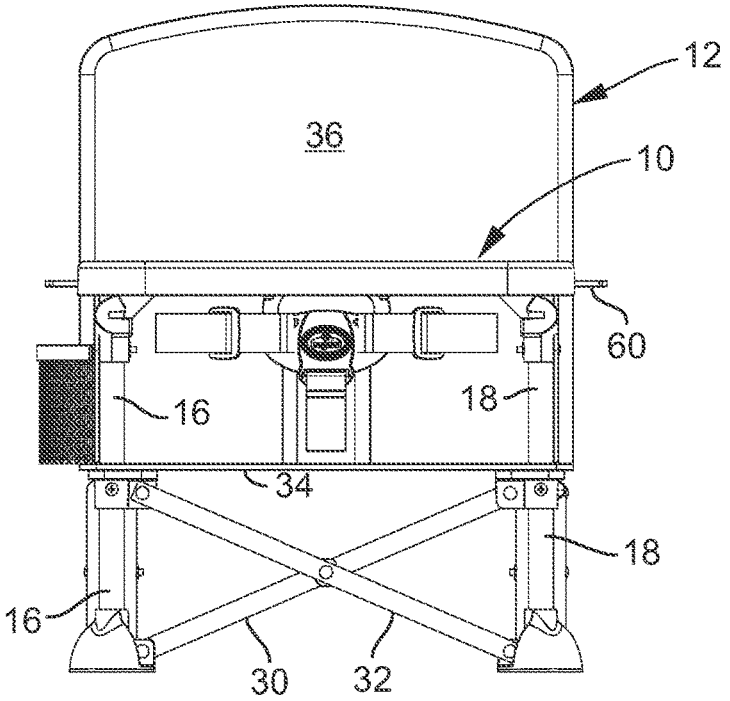
FIG. 2A is a front view of the chair and tray combination of FIG. 1.
Figure 2B:
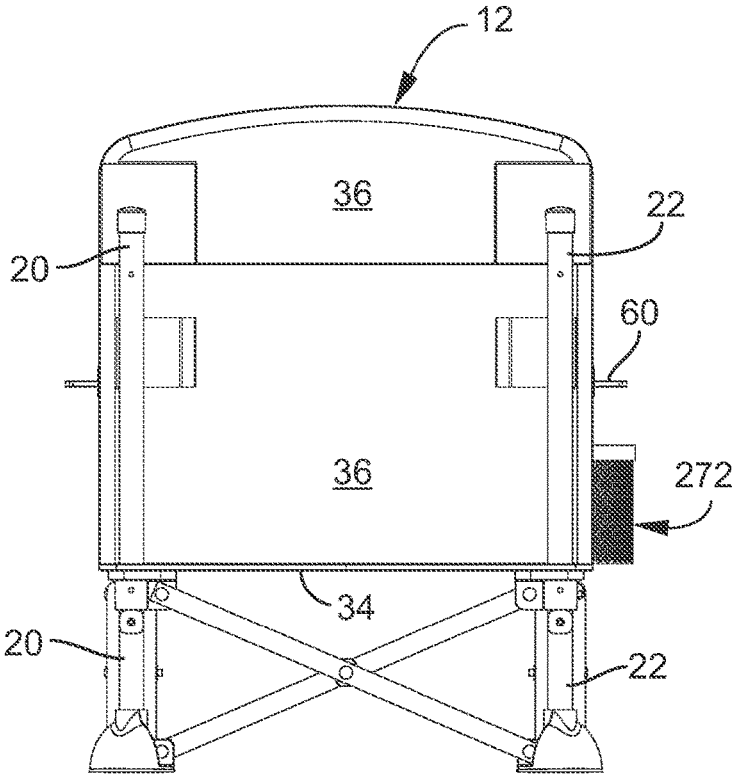
FIG. 2B is a rear view of the chair and tray combination of FIG. 1.
Figure 3A:
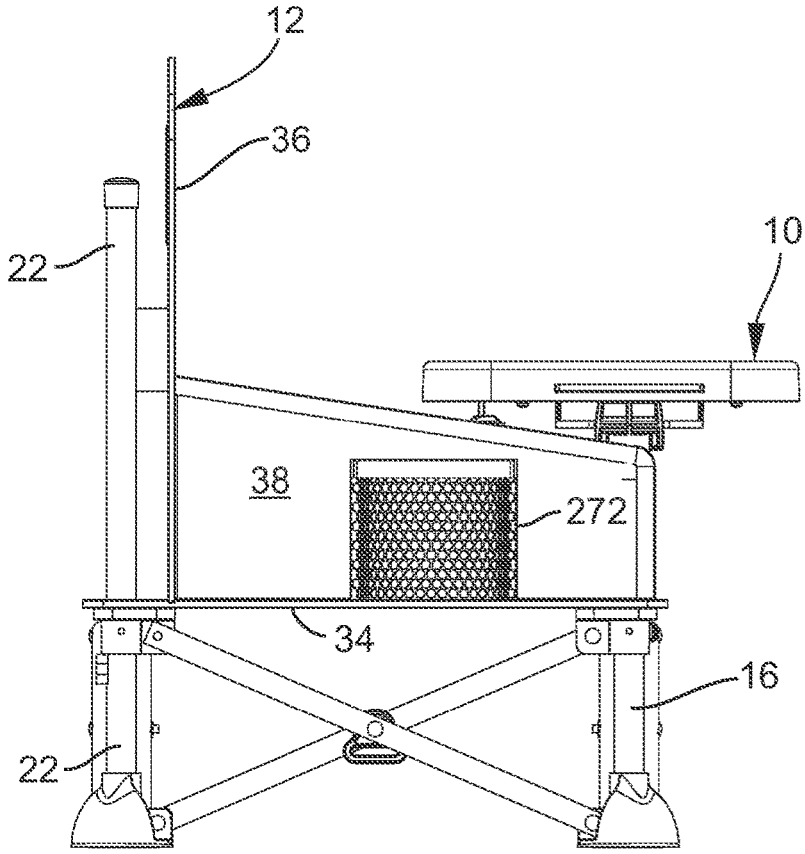
FIG. 3A is a right side elevation view of the chair and tray combination of FIG. 1.
Figure 3B:
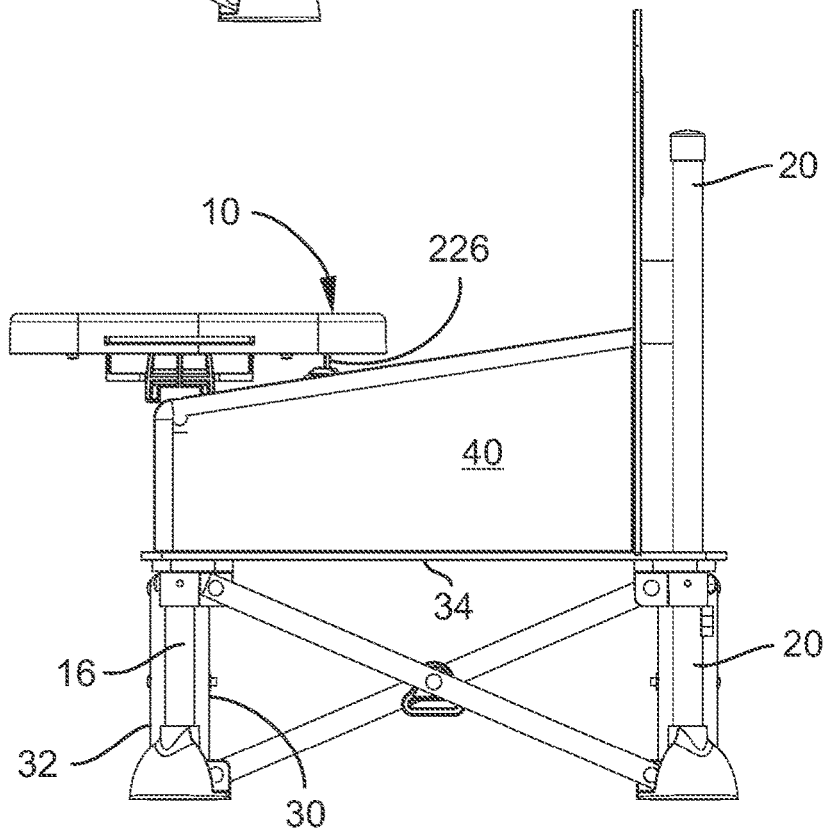
FIG. 3B is a left side elevation view of the chair and tray combination of FIG. 1.
Figure 4A:
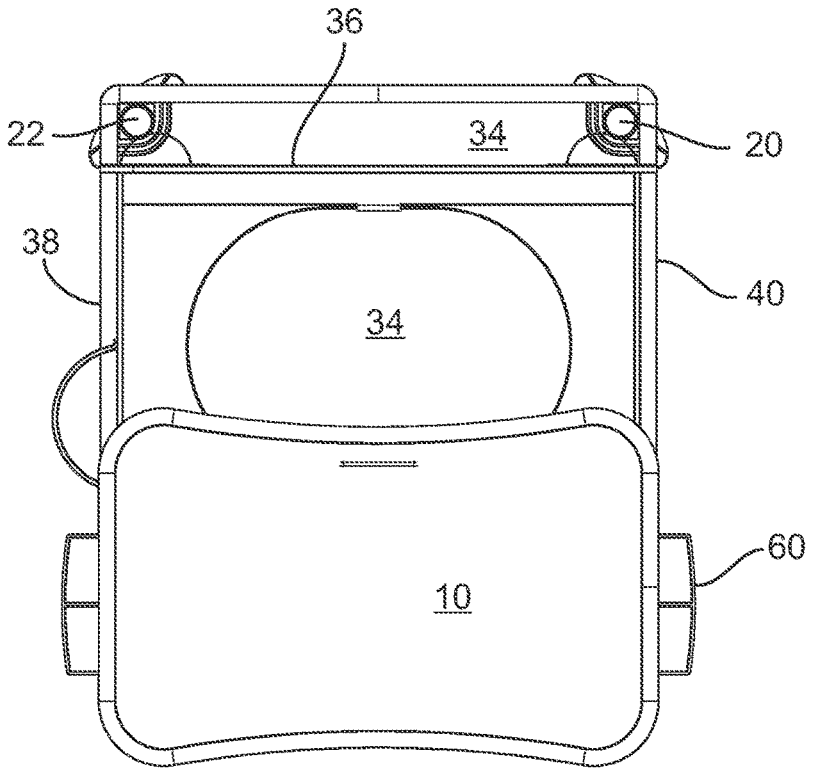
FIG. 4A is a top view of the chair and tray combination of FIG. 1.
Figure 4B:
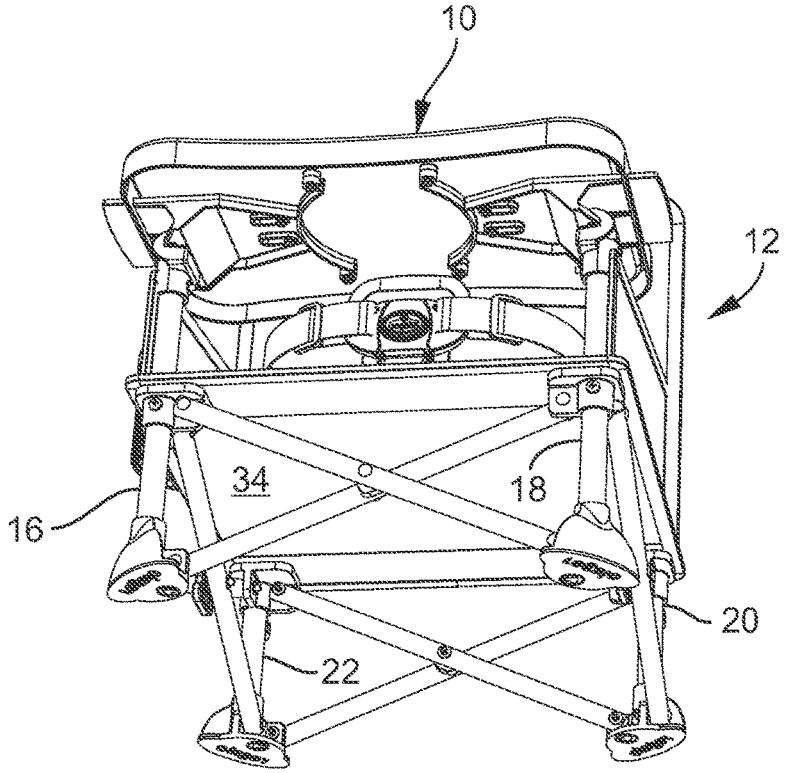
FIG. 4B is a perspective bottom view of the chair and tray combination of FIG. 1.

As shown in FIG. 1, the present tray is indicated by the reference number 10. Tray 10 is engaged to a folding chair 12. As to folding chair 12, the Flannery U.S. Pat. No. 7,422,276 B2 issued Sep. 9, 2008 and entitled Folding Child Booster Seat is hereby incorporated by reference in its entirety.

Chair 12 includes a right front first leg 16, a left front second leg 18, a left rear third leg 20, and a right rear fourth leg 22. Each of the legs 16, 18, 20, 22 has a foot or lower hub 24 and an upper hub 26. A scissoring support apparatus 28 is engaged to the feet 24 and upper hubs 26. The scissoring support apparatus 28 includes four pairs of pivoting support members 30, 32. Member 30 is pivotally engaged to one foot 24 and one upper hub 26. Member 32 is pivotally engaged to one foot 24 and one upper hub 26. Members 30, 32 are pivotally engaged to each other intermediate their ends.

Chair 12 includes a flexible seat bottom 34, a flexible seat back 36, a flexible right side portion 38, and a flexible left side portion 40. Seat bottom 34, seat back 36, flexible right side portion 38, and flexible left side portion 40 form a four sided body receptacle.

Front right leg 16 extends upwardly from its respective foot 24 through a corner of seat bottom 34 and terminates adjacent to the upper front corner of right side seat portion 38. Front left leg 18 extends upwardly from its respective foot 24 through a corner of seat bottom 34 and terminates adjacent to the upper front corner of left side seat portion 40.

Rear left leg 20 extends upwardly though a left rear corner portion of seat bottom 34, behind the seat back 36, and terminates adjacent to a left upper corner of seat back 36. Rear right leg 22 extends upwardly though a right rear corner portion of seat bottom 34, behind the seat back 36, and terminates adjacent to a right upper corner of seat back 36.

Figure 5A:
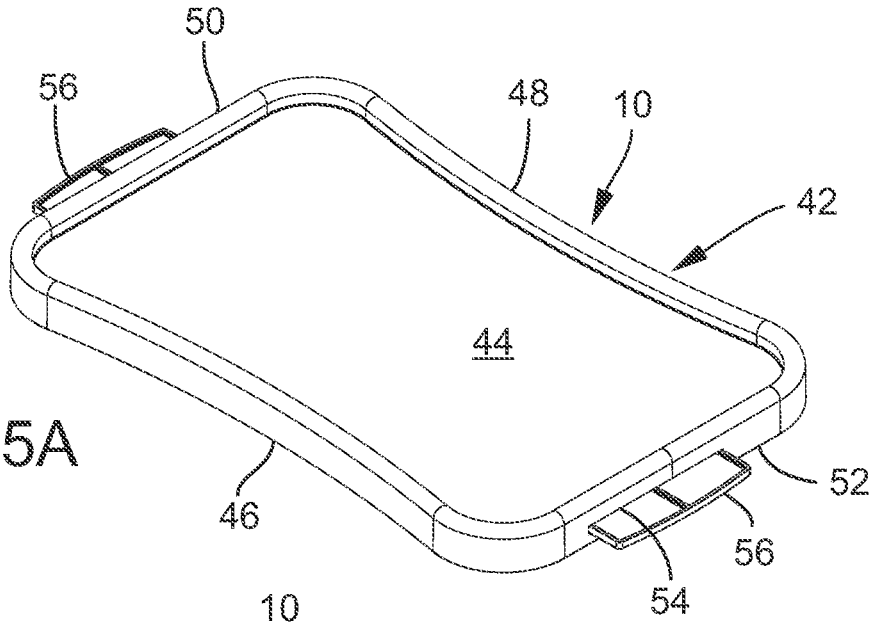
FIG. 5A is a perspective top view of the tray of FIG. 1.

As shown in FIG. 5A, tray 10 includes a peripheral endless lip 42 and a platform 44 within the lip 42. Platform 44 is flat, planar, and smooth. Lip 42 forms generally the shape of a rectangle and includes a front side lip portion 46 that curves inwardly, a rear side lip portion 48 that curves inwardly, a right side lip portion 50 that is straight, and a left side lip portion 52 that is straight. Each of right side lip portion 50 and left side lip portion 52 includes a slot 54 to permit passage of a plate 56. Slot 54 has height and width dimensions slightly greater than or equal to the height and width dimensions of the plate 56 to restrict side to side and vertical movement of the plate 56 that is slideable in slot 54.

Figure 5B:
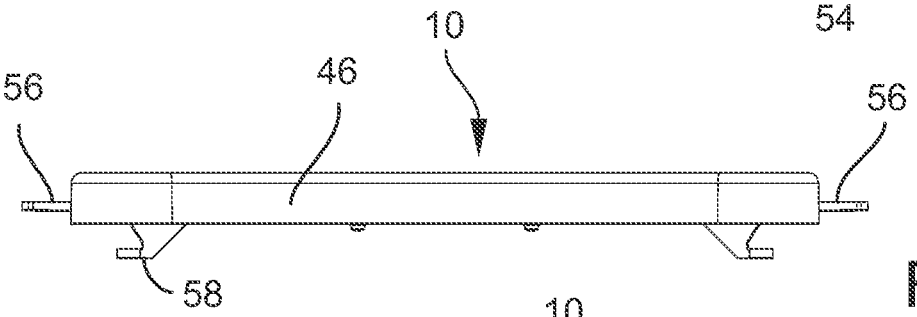
FIG. 5B is a side view of the tray of FIG. 5A.

As shown in FIG. 5B, the tray 10 includes hooks 58. Hooks 58 are one-piece and integral with their respective plates 56. When plates 56 are pushed inwardly, hooks 58 are pushed inwardly toward a middle of tray 10.

Figure 5C:
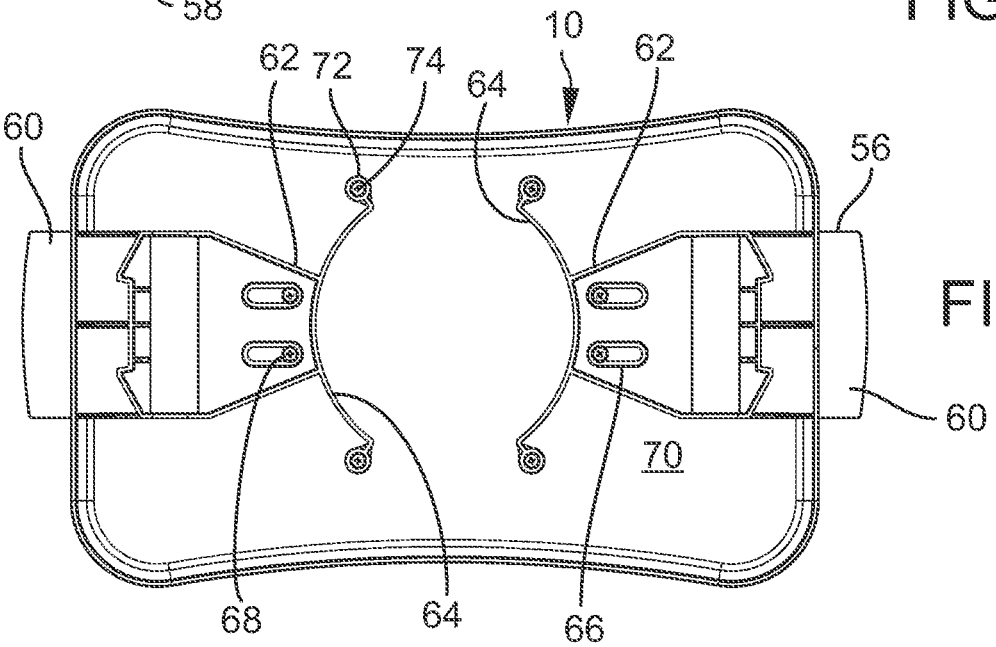
FIG. 5C is a bottom view of the tray of FIG. 5A.

As shown in FIG. 5C, each of plates 56 extend from an accessible outer end 60 to an inner end 62 where the plate 56 integrally engages a resilient outwardly biased band or U-shaped piece 64. Each of the plates 56 includes a pair of slots 66 that engage headed pins 68. The heads of the pins 68 engage edges of the slots or guides 66 to keep the plate 56 engaged to the tray 10 but spaced from a bottom surface 70 of the tray 10. Pins 68 act as guides as the slots 66 ride against pins 68. Integral outward pushing band 64 includes two ends 72, each of which is engaged to tray 10 by a headed pin 74 to keep band 64, and the plate 56 as a whole, engaged to tray 10 and adjacent to the bottom surface 70 of tray 10. If desired, headed pin 74 may permit rotation of band end 74. When the plate 56 is pushed inwardly, hooks 58 travel inwardly and band 64 bends resiliently inwardly. When the inward pushing pressure is released, band 64 automatically and resiliently push hooks 58 and plates 56 outwardly.

Figure 6A:
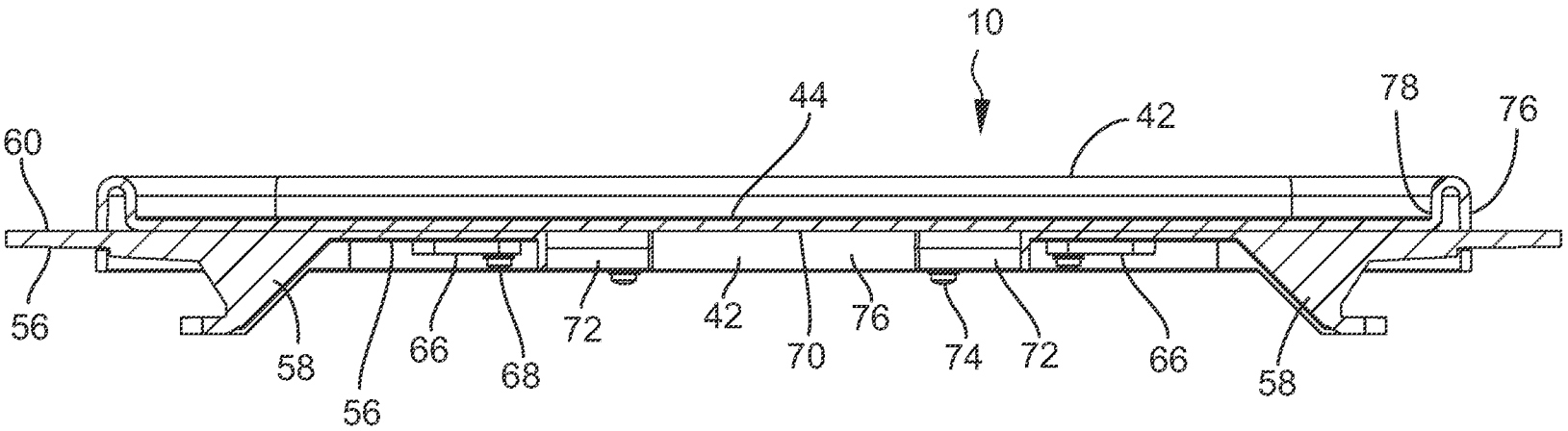
FIG. 6A is a section view of the tray of FIG. 5A.

FIG. 6A shows a section of tray 10. FIG. 6A shows that the lip 42 forms an endless inverted U-shape, with an outer lip wall 76 having a greater vertical length than an inner lip wall 78. Platform 44 is formed intermediate the height of outer lip wall 76. Hooks 58 extend downwardly beyond the lower edge of outer lip wall 76.

Figure 6B:
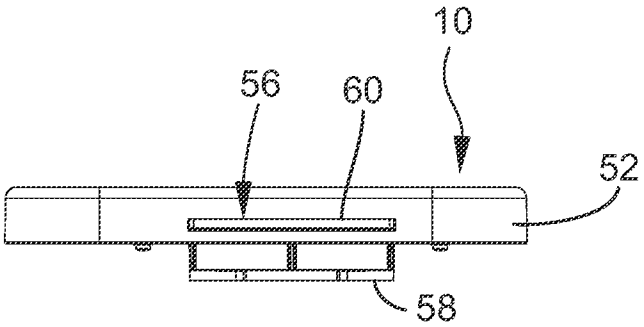
FIG. 6B is an end view of the tray of FIG. 5A.

FIG. 6B also shows that the hooks 58 extend downwardly beyond the lower edge of outer lip wall 76. The width of hook 58 is about equal to the width of outer end portion 60 of plate 56.

Figure 7:
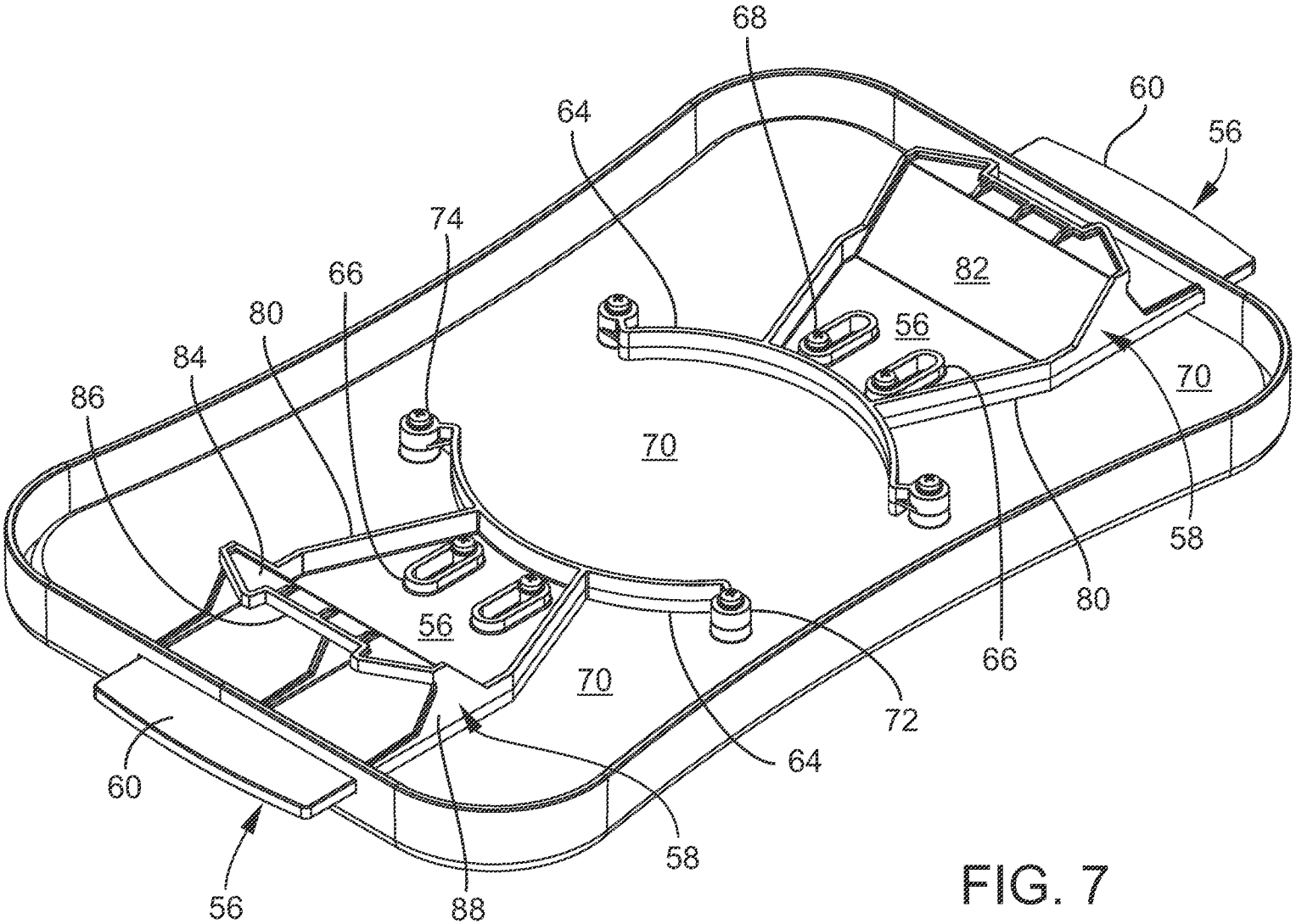
FIG. 7 is a perspective bottom view of the tray of FIG. 5A.

FIG. 7 shows a bottom perspective view of the tray 10. Plate 56 includes depending sidewalls 80 extending from the hook 58 to the resilient integral band 64. Hook 58 includes an oblique end wall 82 extending downwardly and outwardly to a bottom notched wall 84 having a notch 86 formed therein. A brace or bracing wall 88 depends from the plate 56 to be integral with the oblique end wall 82 and the bottom notched wall 84. FIG. 7 shows that the slots 66 have endless depending walls depending from plate 56. Bands 64 flex inwardly and are free of bottom surface 70. Plate 56, hook 58, bands 64 and slots or guides 66 are one-piece and integral with each other.

Figure 8A:
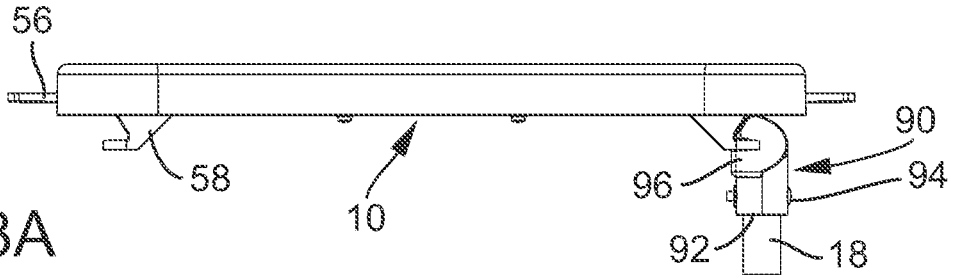
FIG. 8A is a side view of the tray of FIG. 5A with a leg engaged to the tray.
Figure 8B:
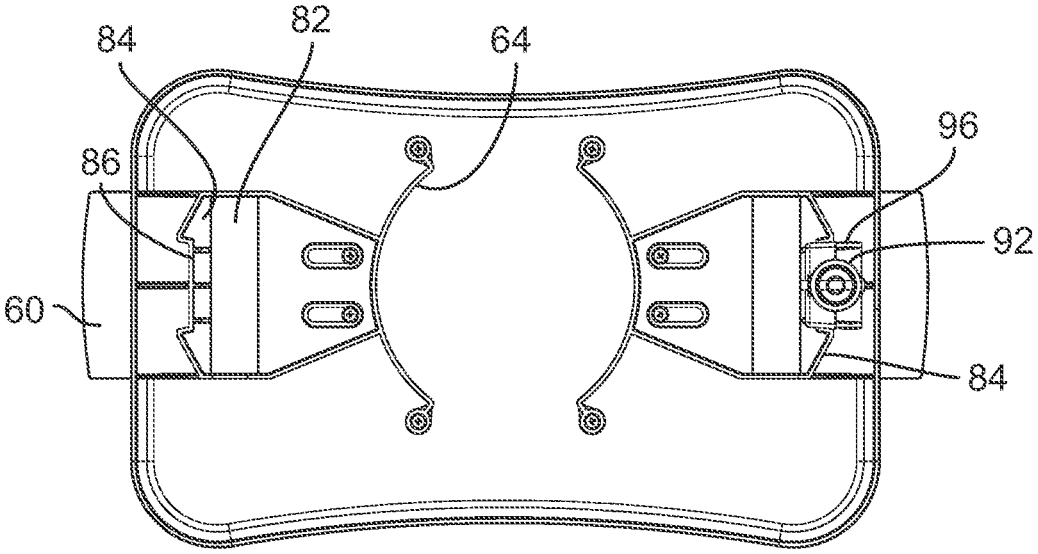
FIG. 8B is a bottom view of the tray of FIG. 8A.
Figure 8C:
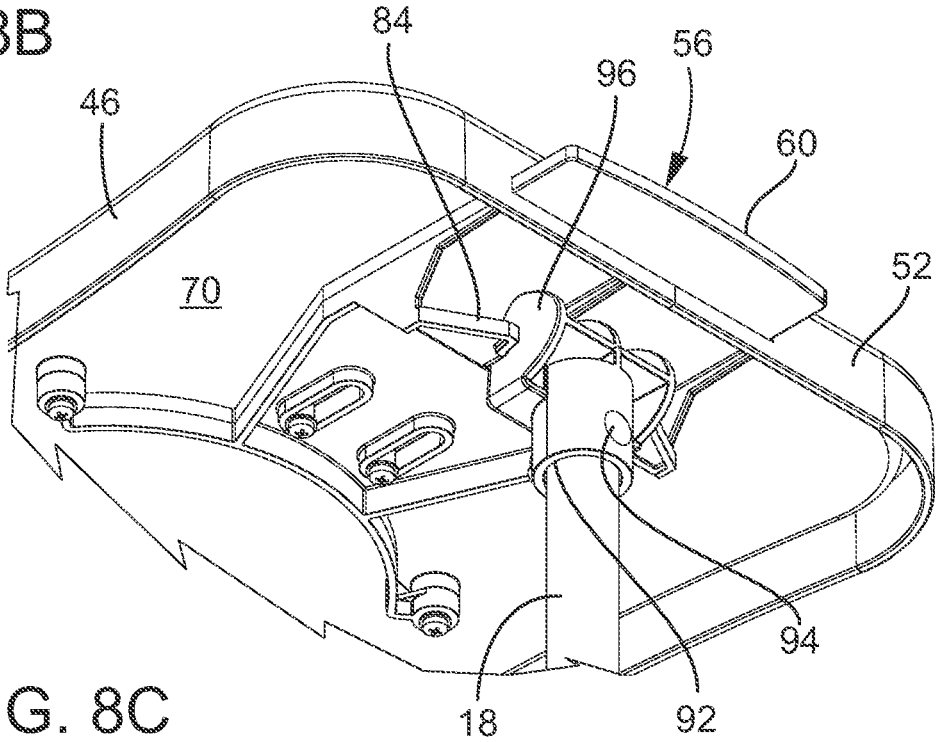
FIG. 8C is a perspective view of a portion of the tray of FIG. 8A.

FIG. 8A shows an engagement between tray 10 and front left leg 18 of chair 12. A connection 90 is engaged between tray 10 and the top of front left leg 18. Connection 90 includes a cylindrical receiver 92 that is pinned to the top of front left leg 18 by a pin connector 94. Integral with the cylindrical receiver 92 is a hook receiver 96 that receives the hook 58. Hook receiver 96 receives the bottom notched wall 84 of hook 58 and further engages the notch 86 so as to limit forward and rearward travel of the tray 10.

Figure 9:
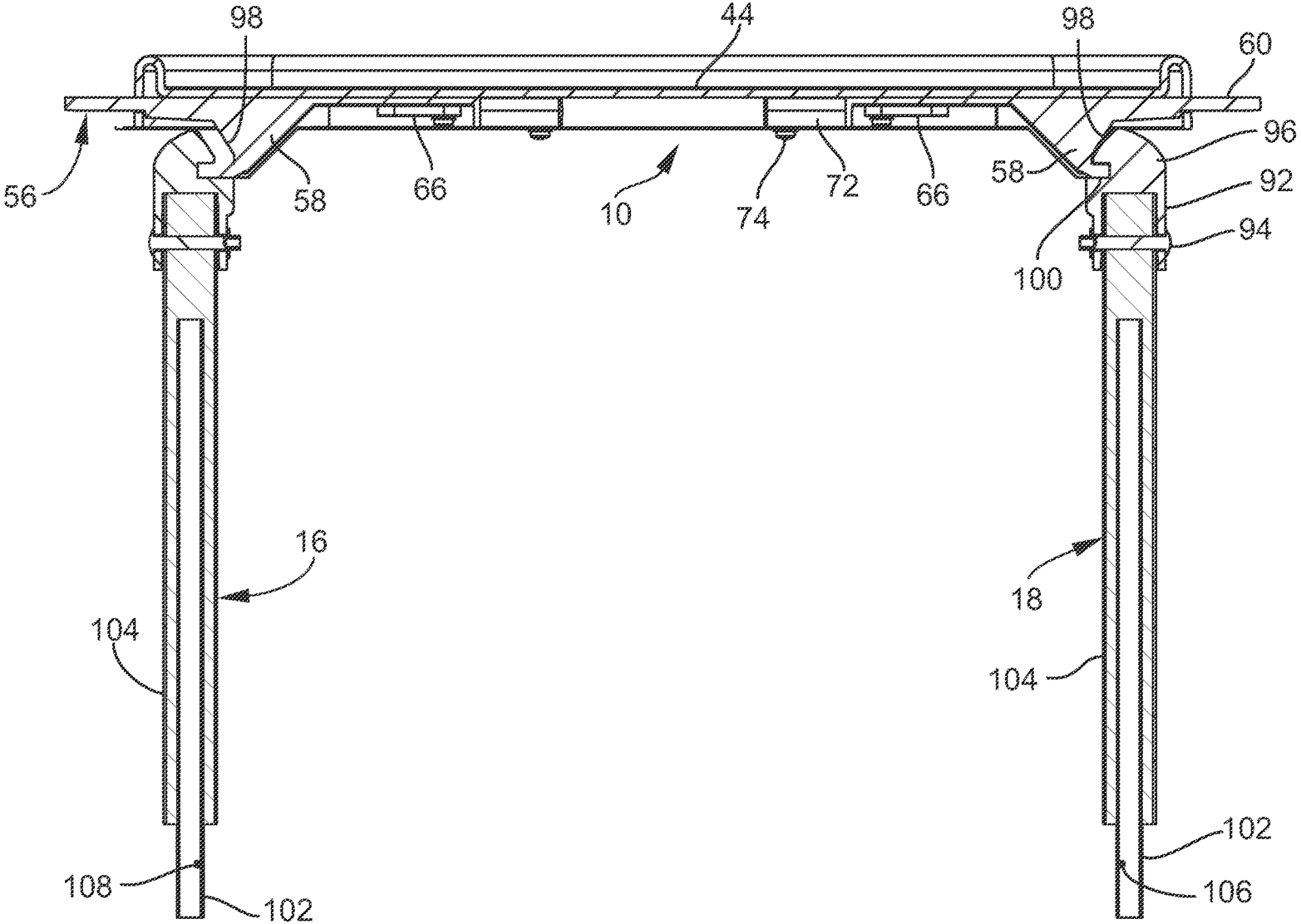
FIG. 9 is a section view of the tray of FIG. 8A showing both legs engaged.

As shown in FIG. 9, a top of hook receiver 96 includes an oblique face 98 extending downwardly and inwardly such that hook 58, or specifically the bottom notched wall 84 of hook 58, can slide against the oblique face 98 until the resilient bands 64 snap the hooks 58 into slots 100 of the hook receivers 96.

Figure 19A:
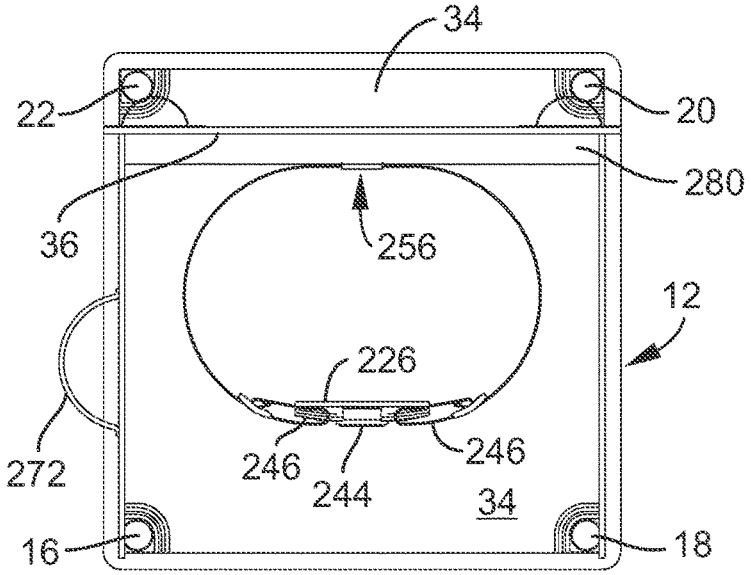
FIG. 19A is a top view of the chair and strap apparatus of FIG. 16.
Figure 19B:
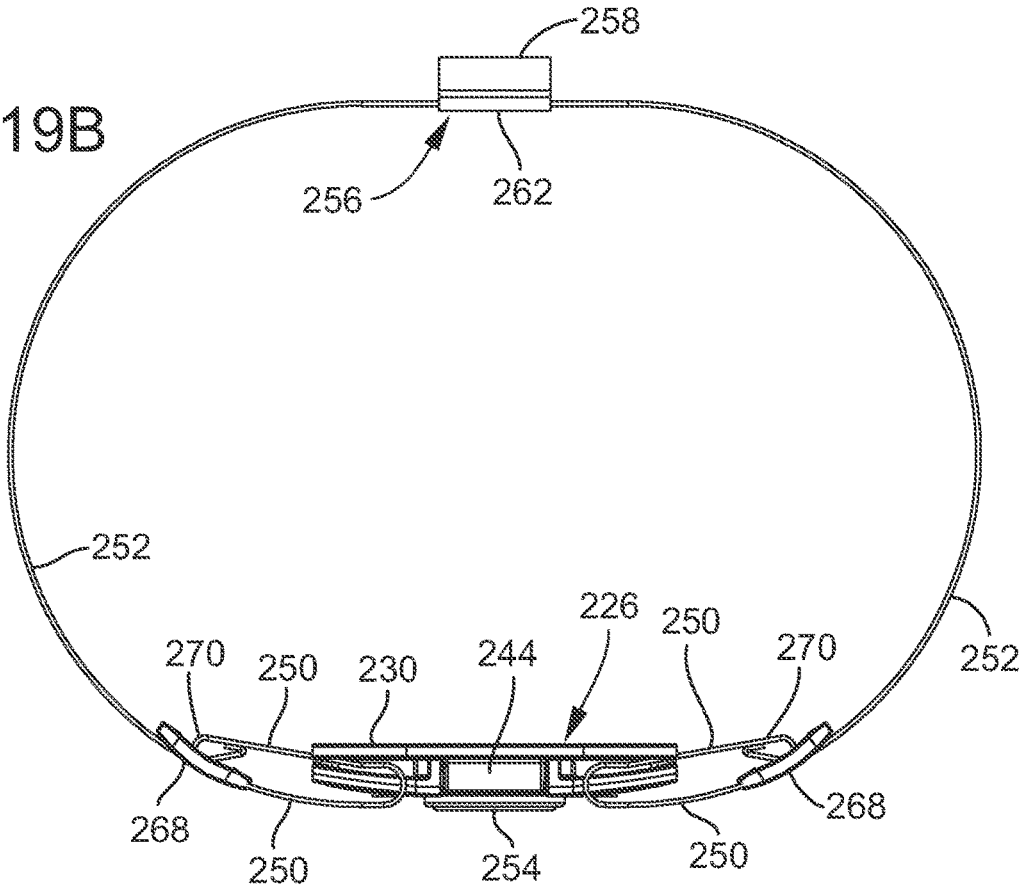
FIG. 19B is a top view of the strap apparatus of FIG. 17.

FIG. 19 shows that legs 16 and 18 have a leg within a leg. In other words, leg 18 includes an internal leg portion 102 and an external leg portion 104. Internal leg portion 102 is a cylindrical tube. External leg portion 104 is a cylindrical tube. Internal leg portion 102 may be friction fit into external leg portion 104. Internal leg portion 102 may include a depressable button 106, as shown relative to leg 18. Or internal leg portion 102 may include a pin connector hole 108, as shown relative to leg 16. Foot 24 may have a hole for receiving depressable button 106 or may have an associated hole for aligning with pin connector hole 108 for receiving a pin connector for engagement of the foot 24 to the tube 102. The upper end of external leg portion 104 includes a pair of aligned holes for receiving pin connector 94. Internal leg portion 102 and external leg portion 104 are about the same length. More than one-half of the internal leg portion 102 is received by external leg portion 104. The cylindrical opening in external leg portion 104 for tube 102 extends more than one-half of the length of external leg portion 104. Leg portions 102, 104 are coaxial.

Figure 10:
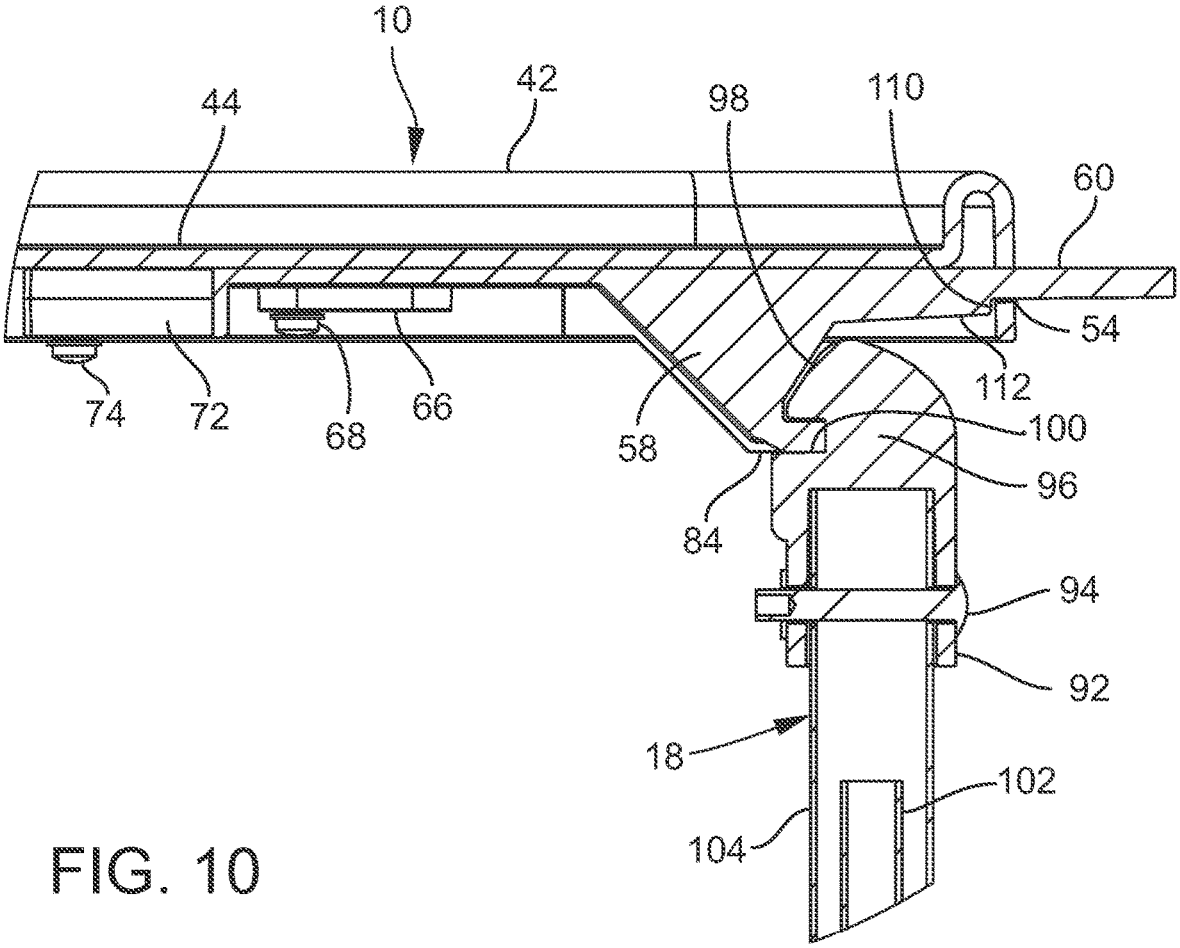
FIG. 10 is a section view of a portion of the tray of FIG. 8A.

FIG. 10 shows that plate 56 includes a stop 110 that is formed by the end of an end wall 112 that is part of the body of the hook 58. End wall 112 runs into and is integral with bracing wall 88. Stop 110 prevents the resilient bands 64 from pushing accessible end portions 60 further out of slots 54. Plate 56 can be pushed inwardly until the pins 68 hit the outer ends of the guides 66. Plate 56 can be pushed outwardly by the bands 64 until the pins hit the inner ends of the guides 66 and/or until the stops 110 hit an inner face of the outer lip wall 76 adjacent to slot 54.

In operation of tray 10, chair 12 is unfolded from a stored position. Chair 12 is not folded and unfolded with the tray 10 engaged to the legs 16, 18. In each of the folded position and unfolded operating position, front legs 16, 18 are engaged to the feet 24 where button 106 or hole 108 is utilized, depending on such type of engagement or another type of engagement. Feet 24 receive internal leg portion 102 so as to be adjacent to and confront the lower end of the external leg portion 104. Legs 16 and 18 are engaged by the corner portions of the seat bottom 34. The upper portions of legs 16, 18 may be engaged in flexible fabric sleeves 113, shown in FIG. 16, where such sleeves 113 are vertically extending, where such sleeves 113 are sewn to the front inner faces of each of the right side portion 38 and left side portion 40, and where such sleeves 113 have an open bottom and an open top, and where such sleeves 113 permit the hook receiver 96 to be open and accessible for the hook 58. Then, with minimum or no pushing in of the accessible outer ends 60, hooks 58 can be pressed down upon the oblique faces 98 of the hook receivers 96, whereupon the hooks 58 and plates 56 are automatically drawn inwardly, whereupon band 64 is compressed. When the outer edges of the notches 86 encounter slot 100, the bands 64 decompress and urge the bottom walls 84 of the hooks 58 into slot 100 to interlock with the slot 100, thereby locking the tray 10 to the legs 16, 18 and thus to the chair 12. During the inwardly and outwardly sliding the heads of pins 68 and the slots 54 maintain a straight and level sliding of the plate 56 and hooks 58 relative to the platform 44. Too much of an inward travel is controlled by the outer ends of guides 66, which encounter pin 68. Too much of an outward travel of plate 56 is controlled by the inner ends of guides 66, which encounter pin 68. To remove the tray 10 from the chair 12, the accessible outer ends 60 are pushed in, an action that pushes the bottom notched walls 84 out of the slots 100. Thus, having been disengaged from slots 100, the tray 10 can be lifted off the top of the legs 16, 18 and plates 56 automatically are pushed out to their normal positions by the bands 64. It should be noted that tray 10 is reversible such that either of the hooks 58 can be engaged to or interlocked with either of the hook receivers 96, such that the front lip portion 46 can be oriented to be closest to the seat back 36, and such that rear lip portion 48 can be oriented to be furthest from seat back 36.

Figure 12:
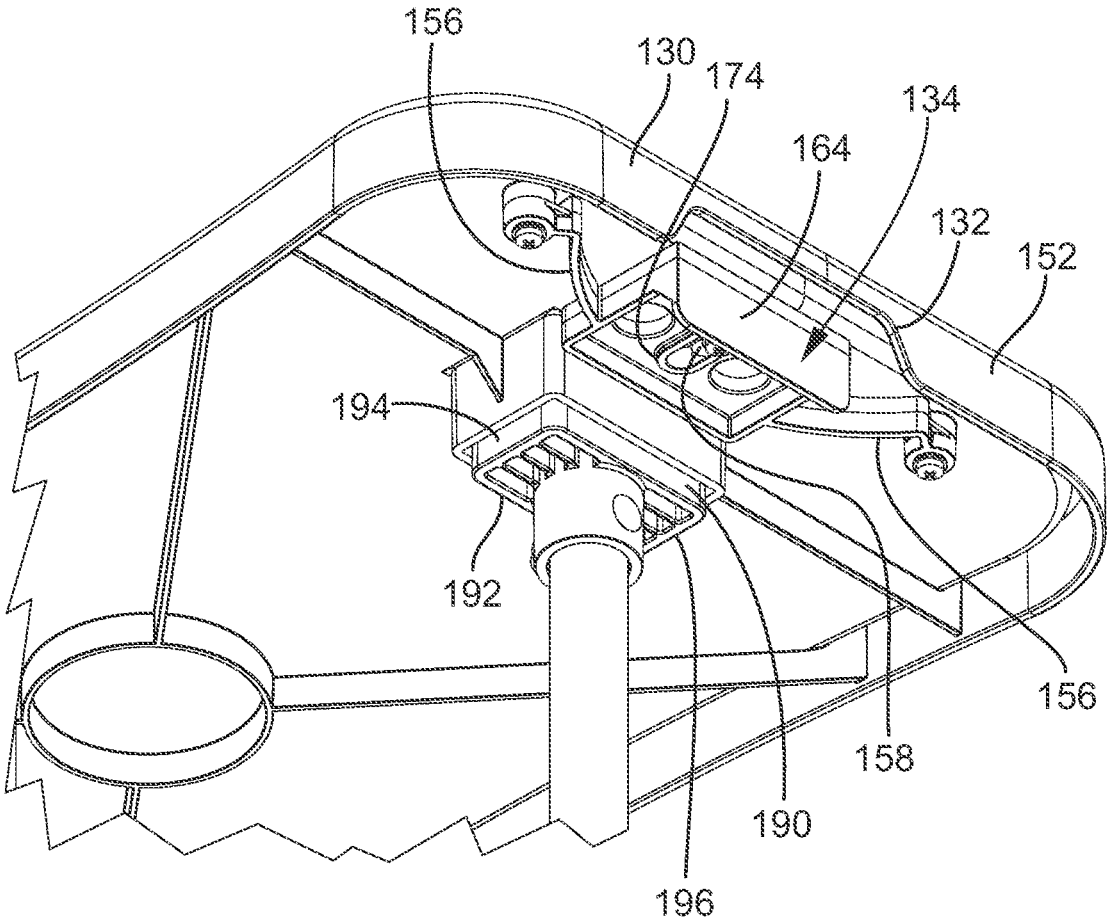
FIG. 12 is a perspective assembled bottom view of the tray of FIG. 11.
Figure 13A:
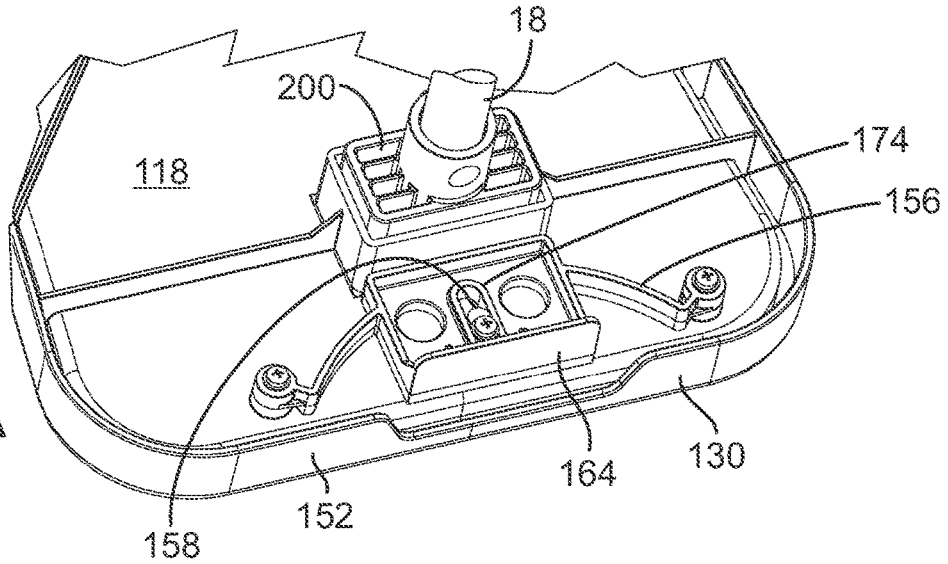
FIG. 13A is a perspective assembled bottom view of the tray of FIG. 11.
Figure 13B:
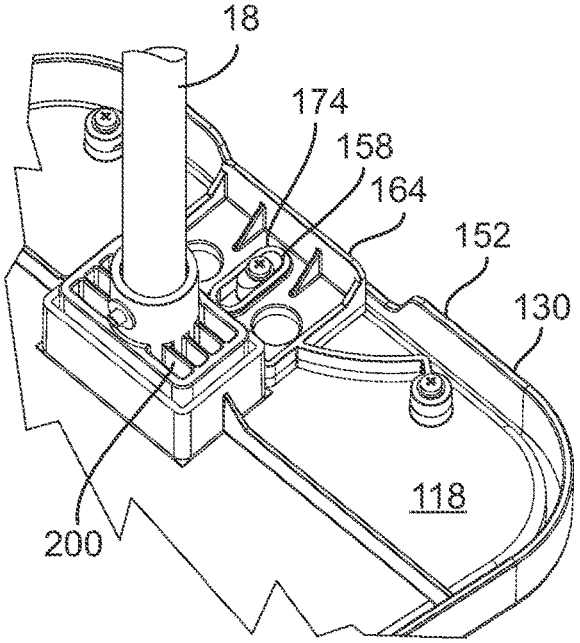
FIG. 13B is a perspective assembled bottom view of the tray of FIG. 11.
Figure 14A:
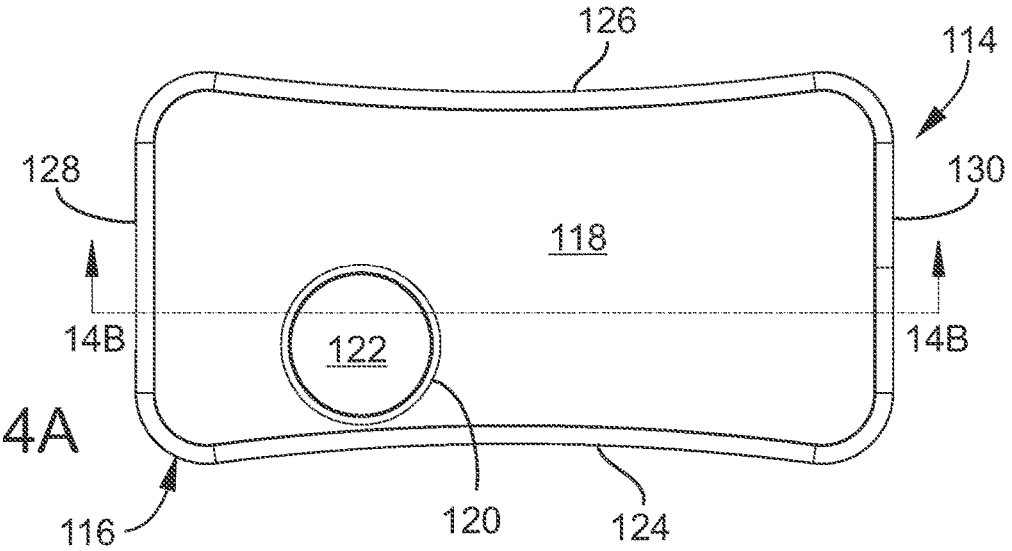
FIG. 14A is a top view of the tray of FIG. 11.

FIGS. 11, 12, 13A, 13B, 14A, 14B, 14C, 15A, and 15B show a tray 114 having an alternate connection 115 to the front legs 16, 18. As shown in FIG. 14A, tray 114 includes a peripheral endless lip 116 and a platform 118 within the lip 116. Platform 118 is flat, planar, and smooth with the exception of a circular endless depending periphery lip leading into a depressed flat, planar, and smooth upper circular surface 122 having a lesser altitude than the upper surface of platform 118. Lip 116 forms generally the shape of a rectangle and includes a front side lip portion 124 that curves inwardly, a rear side lip portion 126 that curves inwardly, a right side lip portion 128 that is straight, and a left side lip portion 130 that is straight. Each of right side lip portion 128 and left side lip portion 130 includes a wide indent or opening 132 to permit hand access to a pusher 134. Pusher 134 is referred to as a pusher because tabs 176 are in a normally biased pushed-in-position in aligned slots 178, 148 by resilient band portions 156. Handle 164 may be referred to as a puller if desired because a hand takes this piece 164 and pulls outwardly to compress the resilient band portions 156 and slide out the tabs 176 from the slots 178, 148 to unlock the connectors 136, 180 apart from each other.

Figure 11:
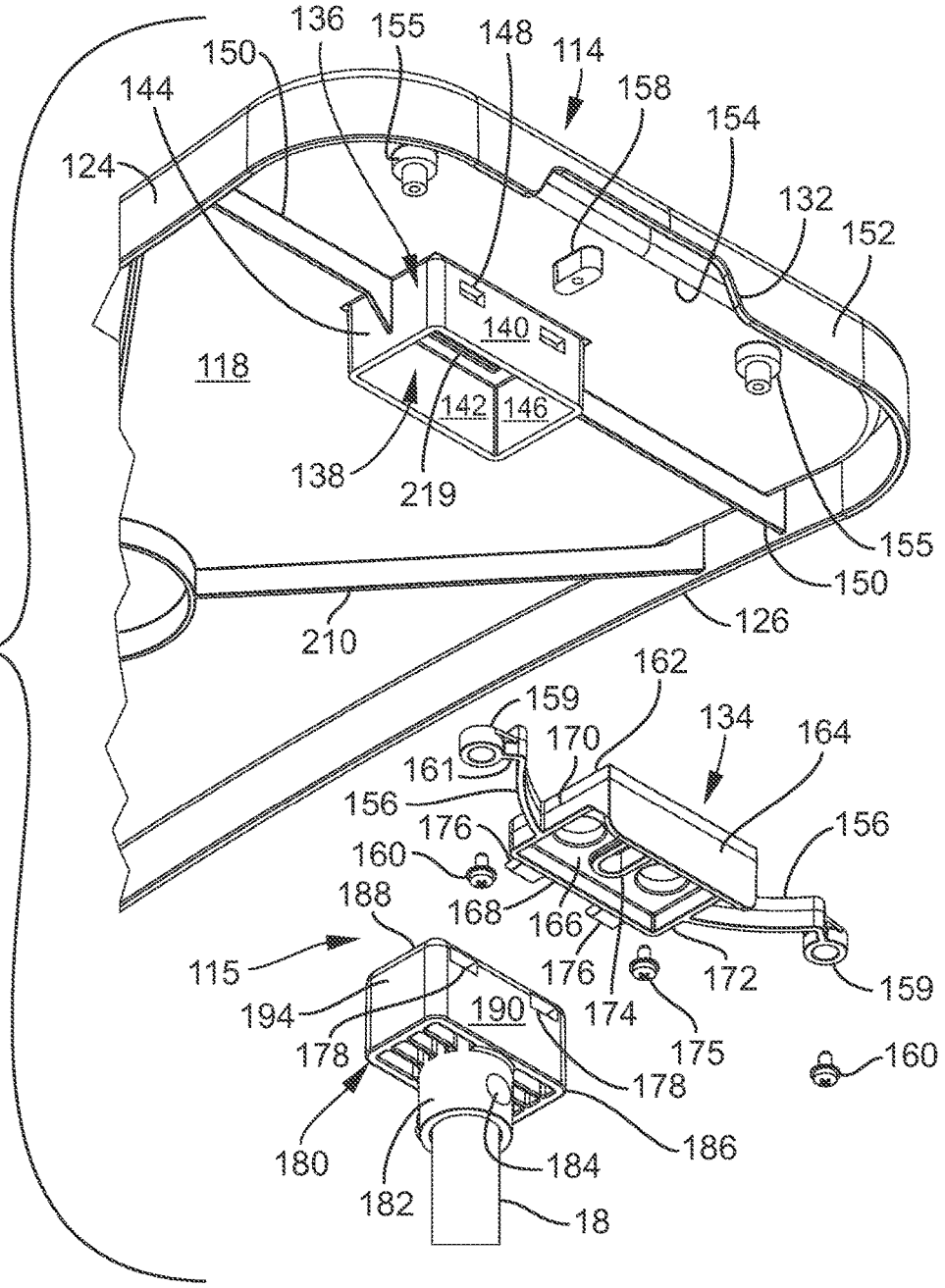
FIG. 11 is a perspective exploded view of an alternate embodiment of the tray of FIG. 5A.

FIG. 11 shows an exploded view of the alternate connection 115. Alternate connection includes an integral open box 136 or female connector 136 having an open bottom 138. Open box 136 includes an outer end wall 140, an inner end wall 142, a front wall or sidewall 144, and a rear wall or sidewall 146. Outer end wall 140 includes a pair of rectangular through openings 148 for engaging the pusher 134. Walls 140, 142, 144, 146 depend at a right angle from platform 118. An integral stiffening rib 150 runs from front lip portion 124 to front wall 144 and further depends from and is integral with platform 118. Another integral stiffening rib 150 runs from rear lip portion 126 to rear wall 146 and further depends from and is integral with platform 118. Endless lip 116 is U-shaped and includes an outer lip portion 152 and an inner lip portion 154. Outer lip portion 152 extends downwardly beyond the platform 118. Inner lip portion 154 integrally merges into the platform 118 at the periphery of the platform 118. A pair of pin receivers 155 are integral with the platform 118 and depend therefrom. A stop 158 further depends integrally from the platform 118.

Pusher 134 includes integral curved band portions 156. Each of the band portions 156 includes an outer annular end 159. Ends 159 are engaged to pin receivers 155 with pin connectors 160. Ends 159 may, if desired, be fixed without rotation relative to pin receivers 155 or, if desired, may be pivotally engaged to pin receivers 155. Ends 159 are offset from the line of curvature of the band portions 156. A straight intermediate integral piece 161 is disposed between band portion 156 and annular end 159.

Pusher 134 includes a body 162. Body 162 includes an outer wall or end or handle or puller 164 that is disposed inside the tray 114 when the tray 114 is locked to the legs 16, 18. Body 162 further includes an upper wall 166, an inner wall 168, a front wall or sidewall 170, a rear wall or sidewall 172. Body 162 is box-shaped. One band portion 156 integrally extends from sidewall 170. The other band portion 156 integrally extends from sidewall 172. Upper wall 166 includes an oblong slot 174 for receiving the oblong stop 158. Pin connector 175 includes a head that rides on an endless lip of slot 174. The heads of pin connectors 175 and 160 engage the pusher 134 to the tray 114. Extending from the inner wall are a pair of locking tabs 176 that extend through rectangular slots 148 of box 136 and that extend into slots 178 of a male connector 180 of leg 18.

Male connector 180 includes an integral cylindrical receiver 182 for receiving the leg 18 or specifically the external leg tubular portion 104 of leg 18. Cylindrical receiver 182 is one-piece and integral with a box like portion 186. Male connector 180 includes the integral box like portion 186. Box like portion 186 includes an upper wall 188, outer end wall 190, inner end wall 192, front wall or sidewall 194, and rear wall or sidewall 196. Box like portion 186 is received through the open bottom 138 and into box 136 when outer end wall 164 is drawn outwardly to draw the locking tabs 176 out of the box 136. Then outer end walls 164 can be released, whereupon the band portions 156 resiliently return to their normal position, thereby returning tab 176 to their home slots 178, thereby locking the tray 114 to the chair 10. It should be noted that end walls 164 have minimal outwardly travel, with such minimal outward travel being controlled by the length of slot 174. The inner end of stop 158 abuts the inner end of slot 174 when the tabs 176 are out of slots 178 but still reside in slots 148. The outer end of stop 158 abuts the outer end of slot 174 when the tabs 176 are in slots 178 and in slots 148.

FIG. 12 shows that, when female connector 136 and male connector 180 are locked by locking tabs 176, outer end wall 164 is disposed inwardly of a plane defined by outer lip portion 152 of left side lip 130. Outer end wall 164 may be referred to as a handle or grip, where a hand is inserted into the tray 114 through indent or opening 132, and where the fingers of the hand curl under outer end wall 164 to pull out the pusher 134. FIG. 12 further shows that the inner end of stop 158 is spaced from the inner end of slot 174 when the band portions 156 resiliently hold the tabs 176 in a locked position in slots 178.

FIGS. 13A and 13B further show that, when the band portions 156 resiliently urge the tabs 176 in the locked position in the slots 178, the outer end of oblong stop 158 has engaged the outer end of oblong slot 174 and that the inner end of oblong stop 158 is spaced from the inner end of oblong slot 174. FIGS. 13A and 13B further show that handle or grip 164 is disposed inwardly of a plane defined by outer lip portion 152 of left side lip 130 when locking tabs 176 are locked in slots 178 of male connector 180. When locking tabs 176 are drawn out of slots 178, but still reside in slots 148, handle or end wall 164 is adjacent to a plane defined by outer lip portion 152 of left side lip 130.

Figure 14B:
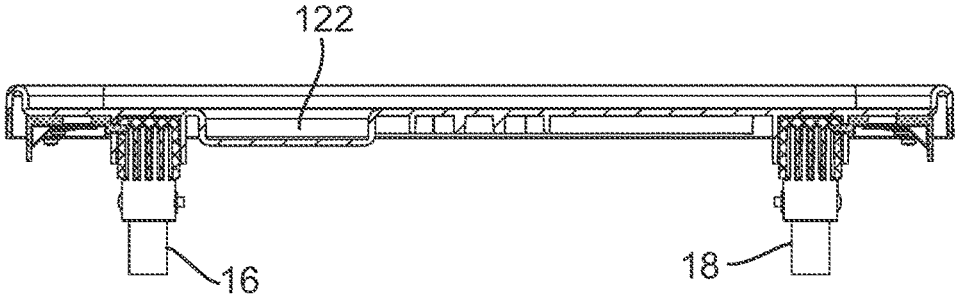
FIG. 14B is a section view at lines 14B-14B of FIG. 14A.
Figure 14C:
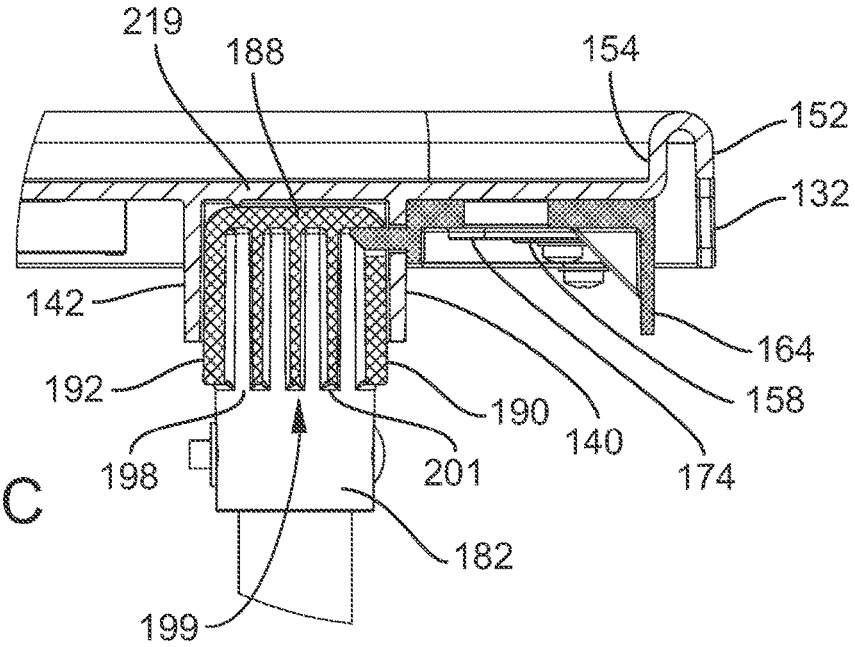
FIG. 14C is a section view of a portion of the tray of FIG. 14B.

FIG. 14C shows the inner end of the oblong stop 158 spaced from the inner end of the oblong slot 174. The distance of such spacing is about the distance between end wall or handle 164 and the outer lip portion 152 to show the maximum travel of the end wall or handle 164 when the handle 164 is operated to draw the locking tabs 176 out of the slots 178 of the male connector 180.

When male connector 180 is in female connector 136, side to side movement and forward and back movement of the tray 10 relative to the legs 16, 18 are minimized by the snug fit of the connectors 180, 136. Outer end walls 190, 140 abut each other. Inner end walls 142, 192 abut each other. Front walls 144, 194 abut each other. Rear end walls 146, 196 abut each other.

FIGS. 14B and 14C show that cylindrical receiver 182 may engage box like portion 186 through a plurality of teeth or ribs and tooth receptors or slots. Cylindrical receiver 182 includes upwardly projecting teeth 198 or ribs 198 and tooth receptors 199 or slots 199 between the teeth 198 or ribs 198. Box like portion 186 includes a set of slots 200 or tooth receptors 200 and teeth 201 or ribs 201 forming such tooth receptors or slots 200. The purpose of such a structure is to close off otherwise open areas where fingers may get stuck. Where such an open area would be, a set of four slots or four tooth receptors 200 formed by teeth 201 or ribs 201 are present. Such an area is formed by transitioning from a cylindrical structure to a rectangular structure, but this area is now closed off by the teeth 201 or ribs 201.

As with tray 10, tray 114 is reversible. In other words, male connector 180 is engagable to either of the female connectors 136 such that either the front lip portion 124 or the rear lip portion 126 may be closest to the seat back 36.

FIG. 15A shows that outer end walls or handles 164 depend to an altitude lower than the lower edge of outer lip portion 152.

FIG. 15B shows that the tray 114 includes oblique stiffening ribs 210 that are integral with platform 118 and run from a circular stiffening rib 212 to front lip portion 124 and rear lip portion 126. Tray 114 further includes oblique stiffening rib portions 214 and 216 that are aligned in a straight line with each other. Oblique stiffening rib portion 214 extends from circular rib 212 to the perimeter 120. Oblique stiffening rib portion 216 runs from perimeter 120 to front lip 124.

It should be noted that FIGS. 11 and 14C show a straight ridge 219 depending from the undersurface of the platform 118. Straight ridge 219 is disposed inside of female connector 136 such that tray 114 includes two straight ridges, one inside of one female connector 136, and the second inside of the other female connector 136. Straight ridge 219 runs longitudinally in the direction from sidewall 146 to sidewall 144. The ends of straight ridge 219 are spaced from sidewalls 146, 144. Straight ridge 219 is disposed adjacent to end wall 142 and opposite of end wall 140, which includes slots 148 that are engaged by locking taps 176. When locking tabs 176 are engaged in slots 178 of male connector 180, tabs 176 may stop the top flat face of the male connector 180 from making contact with the undersurface of platform 118. However, since tray 114 includes two straight ridges 219, one apiece in each female connector 136, tabs 176 may but need not to participate in the function of keeping the flat face of the male connector 180 from making contact with the undersurface of platform 118. If tabs 176 do play such a role, then straight ridge 219 engages one side of the male connector 180 at the top of the connector 180, and the male connector 180 is engaged on the other side by the locking tabs 176 near the top of the connector 180 such that straight ridge 219 works in combination with the locking tabs 176. The purpose of the straight ridges 219 is to minimize any undesirable "welding" of the flat top face of box like portion 186 to the face of the undersurface of platform 118 that is disposed inside the four walls 140, 142, 144, 146 of female connector 136. Without such a slight spacing the plastic of the underside of platform 118 may stick or "weld" over time to the plastic of the flat top face of box like portion 186, which sticking or "welding" may make it problematic to remove the tray 114 from the male connector 180. When straight ridges 219 accomplish such a function on their own, without aid from locking tabs 176, then locking tabs 176 more easily slide into and out of an engagement with male connector 180.

Ridge 219 further minimizes a rocking of the tray 114. To make sure that there is room for the male connector 180 to position itself for reception of locking tabs 176, a gap or small amount of space is provided between the upper surface of the male connector 180 and the lower surface of the platform 118. However, gaps tend to permit rocking. To minimize such rocking of the tray 114, the longitudinal ridge 219 is provided and takes up most of the gap. It can also be noted that the locking tabs 176 extend in the lateral direction and engage the male connector 180 in the lateral direction while the ridge 219 extends cross-wise of the lateral direction, i.e., in the longitudinal direction. By employing such features cross-wise each other, both of which engage the male connector 180, rocking of the male connector 180 is further minimized.

In operation of tray 114, chair 12 is unfolded from a stored position. Chair 12 is not folded and unfolded with the tray 114 engaged to the legs 16, 18. In each of the folded position and unfolded operating position, front legs 16, 18 are engaged to the feet 24 where button 106 or hole 108 is utilized, depending on such type of engagement or another type of engagement. Feet 24 receive internal leg portion 102 so as to be adjacent to and confront the lower end of the external leg portion 104. Legs 16 and 18 are engaged by the corner portions of the seat bottom 34. The upper portions of legs 16, 18 may be engaged in flexible fabric sleeves 113, where such sleeves 113 are vertically extending, where such sleeves 113 are sewn to the front inner faces of each of the right side portion 38 and left side portion 40, and where such sleeves 113 have an open bottom and an open top, and where such sleeves 113 permit the male connector 180 to be accessible to the female connector 136. Then, the box like female connector 136 is dropped onto box like male connector 180, which is received inside of the box like female connector 136 until the upper wall 188 of the box like male connector 180 hits the undersides of the locking tabs 176. Then the handles 164 or outer end walls 164 may be drawn outwardly, an action that compresses the resilient band portions 156. As the handles 164 are drawn outwardly, locking tabs 176 slide out of the interior of female connector 136 but still may reside in slots 148. Then the upper wall 188 of box like male connector 180 can be fully received in the box like female connector 136, whereupon slots 178 line up with slots 148 and permit locking tabs 176 to engage slots 178 of male connector 180 when the handle 164 is released and the band portions 156 automatically urge the locking tabs 176 inwardly, thereby locking the tray 114 to the chair 12. During such inwardly and outwardly sliding, the distance of such sliding is regulated by the oblong stop 158 sliding in the oblong slot 174. Too much inward travel is controlled by the inner ends of oblong stop 158 and oblong slot 174 abutting each other. Too much outward travel is controlled by the outer ends of oblong stop 158 and oblong slot 174 abutting each other. To remove the tray 114 from the chair 12, the accessible outer ends 164 are drawn out, an action that draws locking tabs 176 out of slots 178 of male connector 180. Then tray 10 can be lifted off the top of the legs 16, 18 and locking tabs 176 automatically are pushed out to their normal positions by the band portions 156.

FIGS. 16, 17, 18A, 18B, 19A, and 19B show a strap apparatus 218 for the chair 12. Strap apparatus 218 includes a post 220. Post 220 may be rigid if desired and support the tray 10. Post 220 may be flexible, on the order of fabric, if desired. Post 220 may be semi-rigid if desired. Post 220 includes a base 222 that is engaged, such as by being sewn, or such as with hook and loop connectors such as Velcro®, to the seat bottom 34 such that base 222 acts as a hinge to permit post 220 to lay flat when not in use. Post 220 is generally a flat piece and includes a bottom rectangular section 224 and a top oblong section 226. Top oblong section 226 includes an upper flat edge 228 for engaging the undersurface of tray 10 or tray 114. Top oblong section 226 includes an oblong perimeter 230 and an inner oblong portion 232. Bottom rectangular section 224 includes standards 234 and an inner portion 236 between the standards 234. The inner portion 236 mounts, such as by adhesive, or by being sewn, or with hook and loop connectors such as Velcro®, a strap portion 238 that includes an upper sleeve 240 that receives a horizontal arm 242 of a main buckle 244. Sleeve 240 passes through a slot formed between the body of the main buckle 244 and the arm 242. Standards 234 are integral with perimeter 230. Bottom rectangular section 224 is integral with top oblong section 226.

An arm 242 of main buckle 244 is pivotally engaged in sleeve 240. When main buckle 244 is not in use, main buckle 244 can pivot downwardly and out-of-the-way. When in use, inner oblong section 232, perimeter 230, top oblong section 226 as a whole, and an upper portion of bottom rectangular section 224 isolate the main buckle 224 from the child in the chair 12. Whereas the main buckle 244 is relatively small in dimension and may dig into a child's body, the post 220, including the bottom rectangular section 224 and top oblong section 226, are relatively wide to provide more surface area and hence distribute pressure from the strap apparatus 218 over a greater portion of the child's torso. The height of the post 220 is greater than the height of the main buckle 244, including the arm 242. The width of the main buckle 244 plus the widths of the couplers 246 is about equal to the width of the oblong section 226. The width of the top oblong section 226 is greater than the width of the main buckle 244. The width of the bottom rectangular section 224 is greater than the width of the main buckle 244.

The couplers 246 are male couplers. Main buckle 244 includes female connections. Each of the couplers 246 includes an arm 248 for engaging a loop 250 of a horizontal strap portion 252. Loop 250 passes through a slot formed between the arm 248 and the body of the main buckle 244.

Main buckle 244 includes a button 254 that is depressed to release the couplers 246 from the main buckle 244. Couplers 246 automatically engage the main buckle 244 when inserted therein.

Strap apparatus 218 further includes a rear anchor 256. Rear anchor 256 is an S-shaped piece. The piece may be rigid, semi-rigid, or flexible in the nature of fabric. Rear anchor 256 is spaced from seat back 36. Rear anchor 256 includes a base 258, a vertical section 260, and an overlap section 262. A slot 264 is formed between the vertical section 260 and the overlap section 262. The slot 264 receives a section of strap portion 252. Base 258 is engaged, such as by being sewn, or by adhesive, or with hook and loop connectors such as Velcro®, to seat bottom 34. Base 258 extends from the front side of seat back 36 to the rear side of seat back 36.

If desired, vertical section 260 may be engaged, such as by being sewn, or by adhesive, or with hook and loop connectors such as Velcro®, to the front side of seat back 36. Overlap section 262 extends to the front side of vertical section 260. If desired, slot 264 may be closed such that slot 264 does not have an open bottom end. If desired, slot 264 may have a pair of side openings only. The side openings permit the strap portion 252 to be slid in the horizontal direction. If desired, sections 266 of strap portion 252 may be engaged, such as by being sewn, to seat back 36. If desired, sections 266 may be engaged, such as by hook and loop connectors such as Velcro®, to the front side of seat back 36. Strap portion 252 may be removable downwardly out of slot 264 and disconnectable from main buckle 244 for cleaning such as in a washing machine.

Strap apparatus 218 includes buckle length adjusters 268. Each of the strap portions 252 passes through one of the buckle length adjusters 268, then merges integrally with a strap section of one the strap loop portions 250, which strap section then engages one of the couplers 246, which strap section then returns to its respective length adjuster 268 to which it is pivotally engaged by a loop 270.

In operation, post 220 may be engaged to a seat bottom 34 by the hook and loop connectors of base 222. Then, rear anchor 256 may be engaged to seat bottom 34 by one or more of hook and loop connectors of base 258. Then, unless the rear anchor 256 is spaced from the seat back 36, rear anchor 256 may be engaged to the seat back 36 by hook and loop connectors of vertical section 260 and/or by hook and loop connectors 266 of strap sections 252. Then the child may be placed in the chair 12. Then the post 220 may be positioned upright and the couplers 246 can be engaged to the main buckle 244. Then the length adjusters 268 can be operated to tighten or loosen the length of strap sections 252. Then tray 10 or tray 114 can be engaged to legs 16, 18. The underside of such tray 10 or 114 can be supported by the flat upper edge 228 of top oblong section 226. To take the child out of the chair 12, the tray 10 or 114 may be removed. Then couplers 246 may be disengaged from the main buckle 244 and then the post 220 can be swung down. Then the child may be lifted out of the chair 12.

Figure 16:
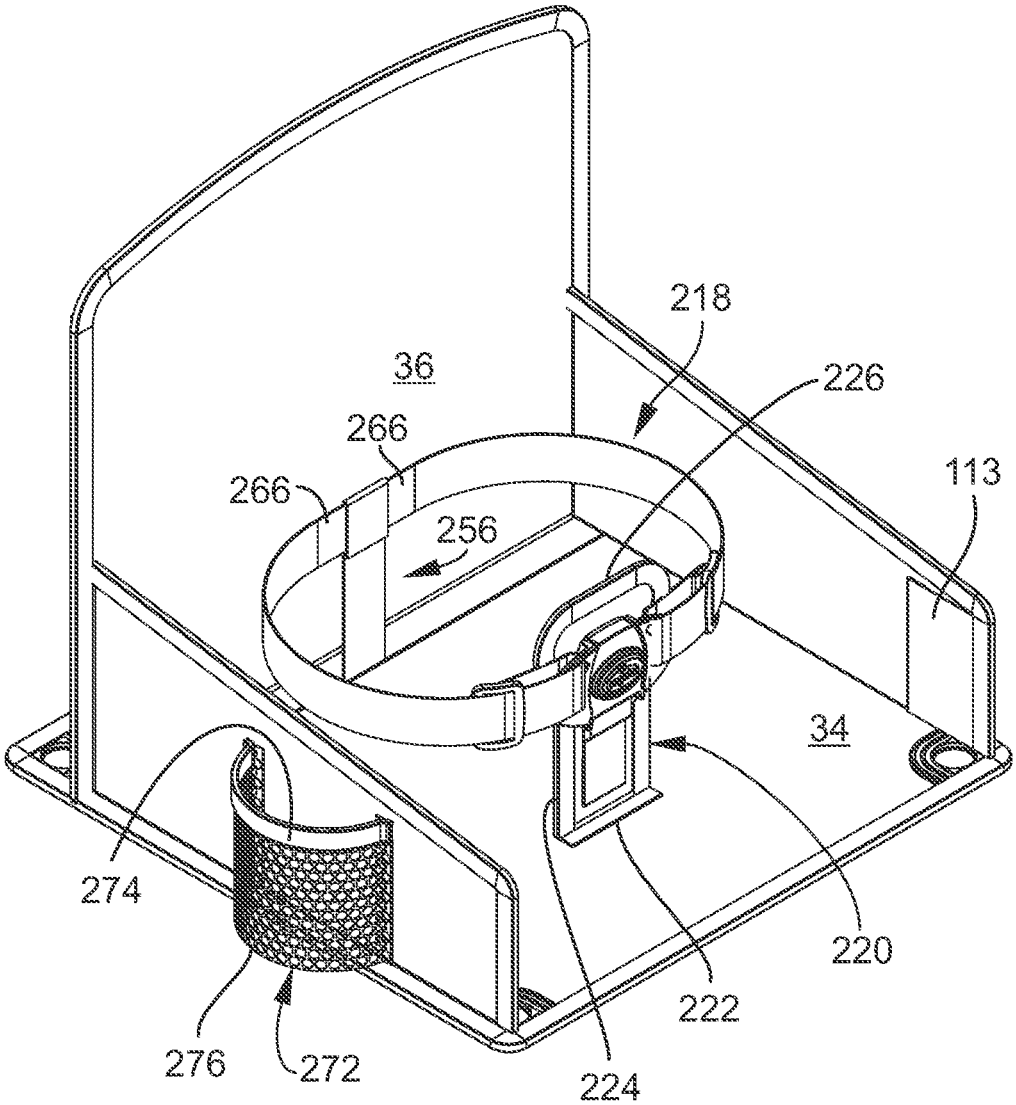
FIG. 16 is a perspective view of the seat of the chair of FIG. 1 having a strap apparatus that may support the tray of FIG. 1 or FIG. 11.
Figure 17:
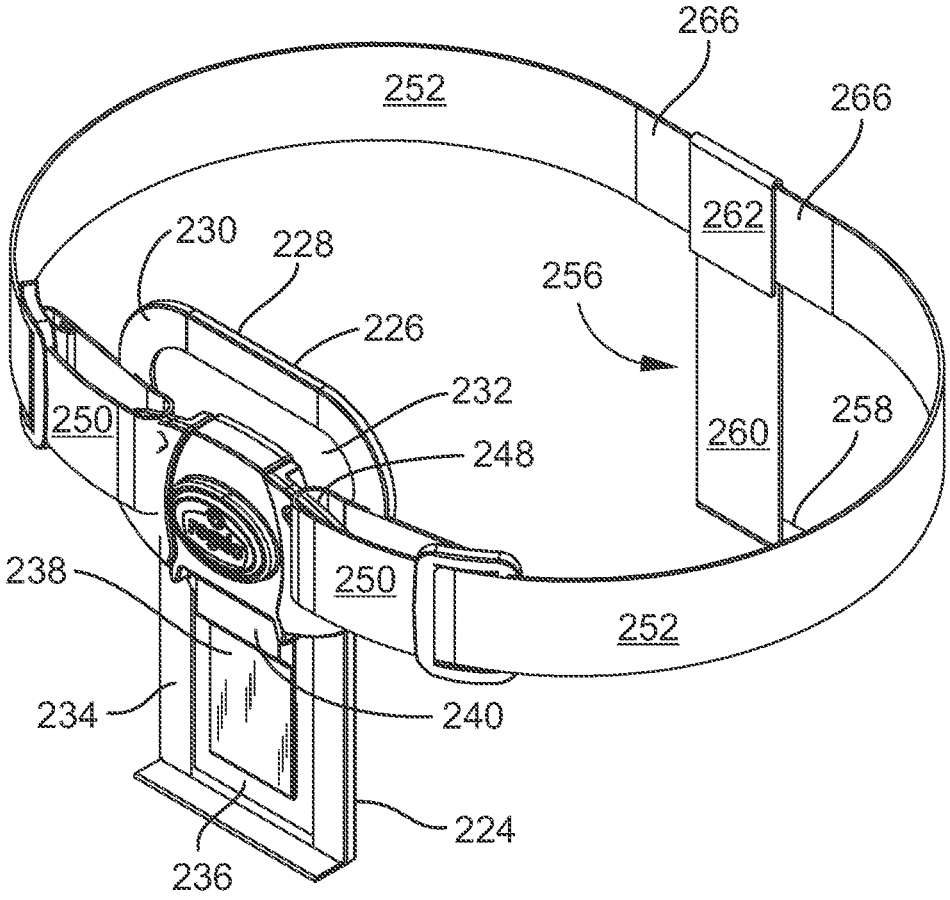
FIG. 17 is a perspective view of the strap apparatus of FIG. 16.
Figure 18A:
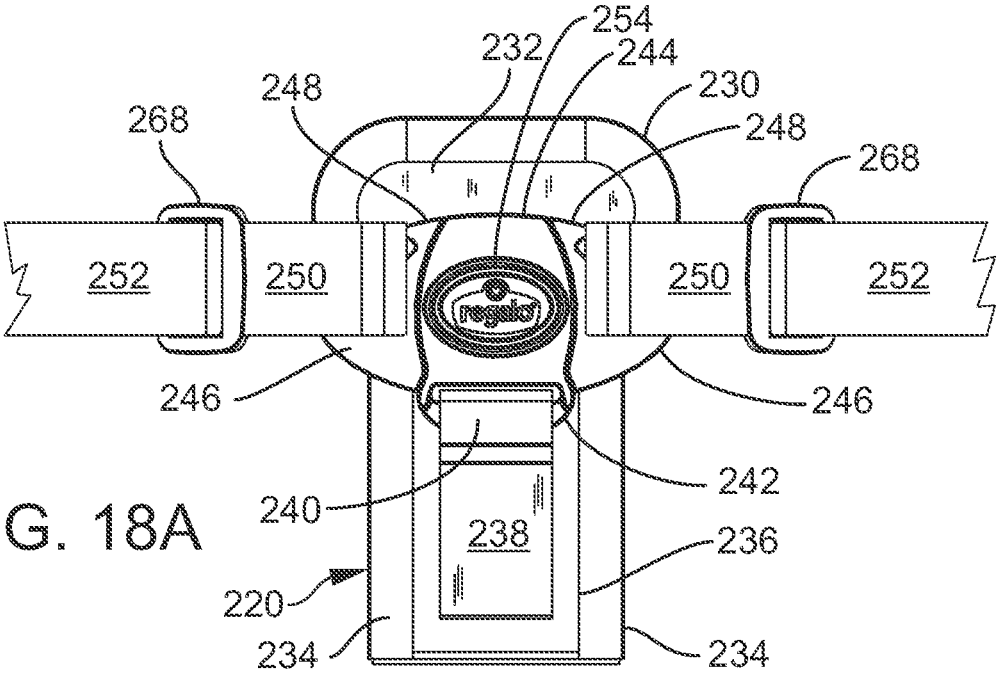
FIG. 18A is a front view of the strap apparatus of FIG. 17.
Figure 18B:
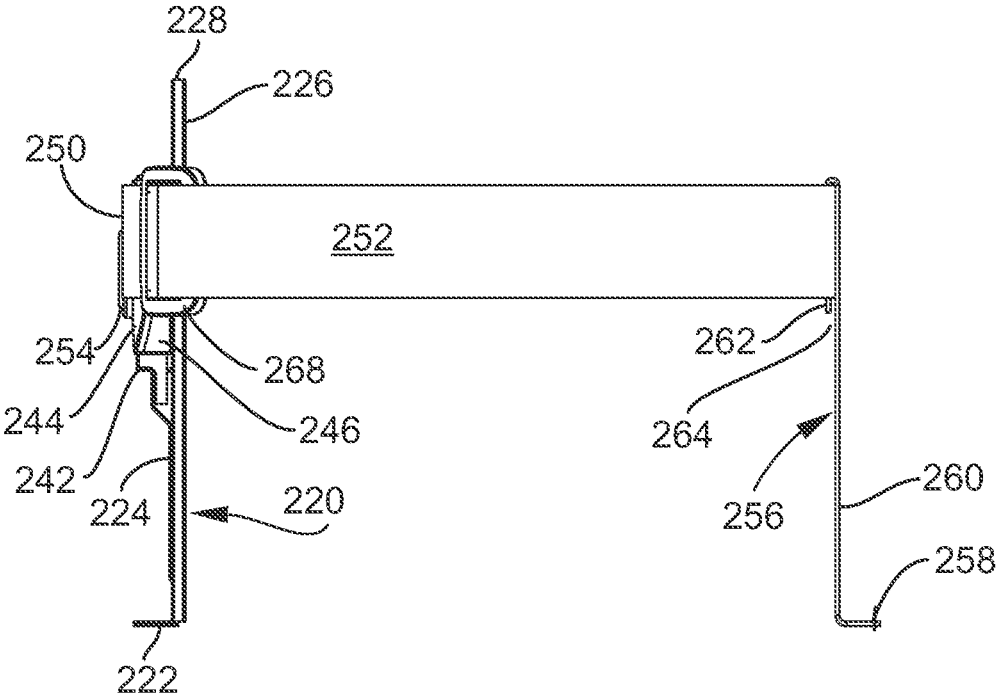
FIG. 18B is a side view of the strap apparatus of FIG. 17.
Figure 20:
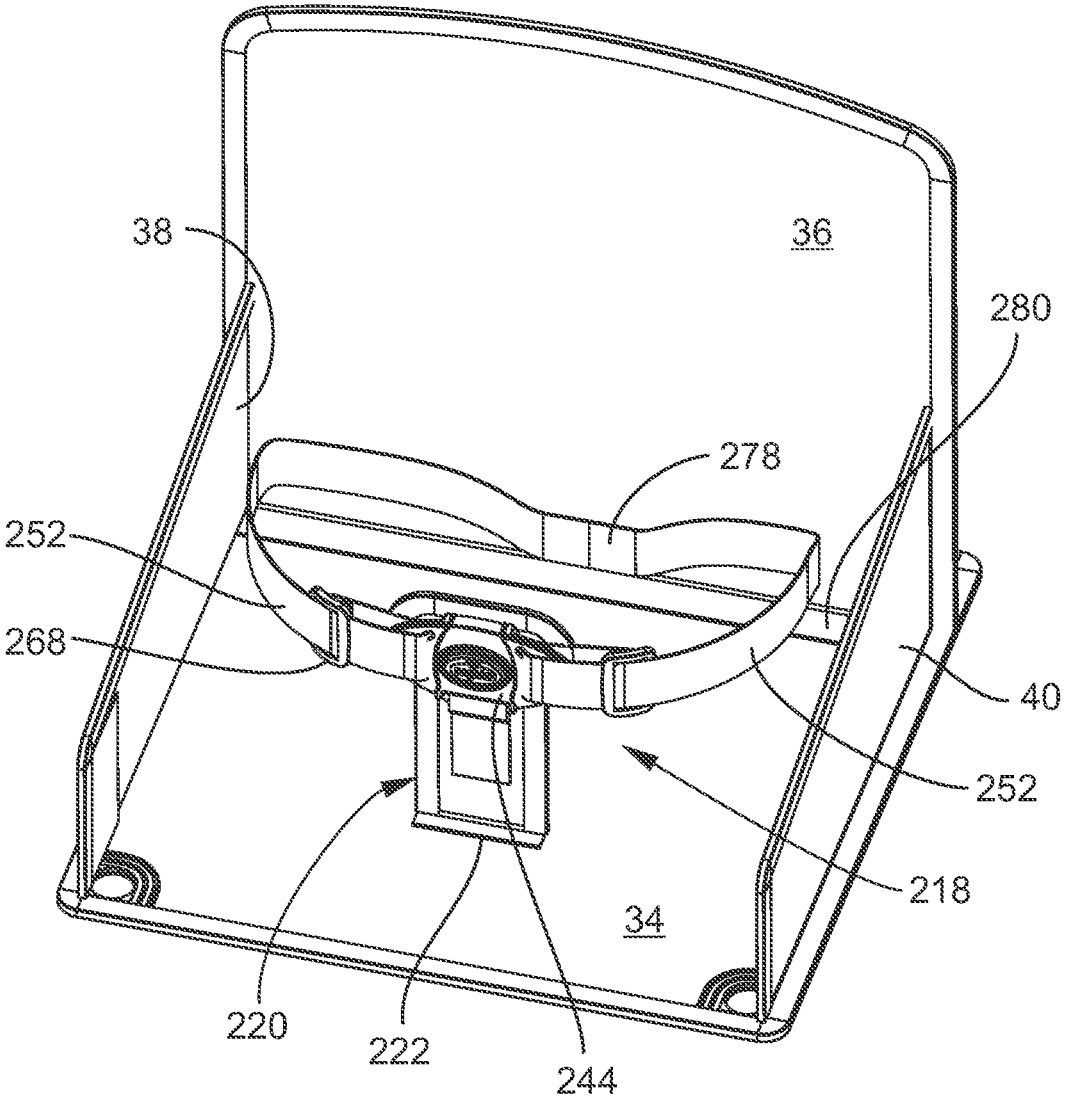
FIG. 20 is a perspective view of an alternate way to engage a rear strap portion of the strap apparatus of FIG. 16 to the seat back of the chair of FIG. 1.

FIG. 20 is a perspective view of an alternate way to engage a rear strap portion 278 of the strap apparatus 218 of FIG. 16 to the seat back 36 of the chair 12 of FIG. 1. Chair 12 includes a horizontally and laterally extending reinforcing strap 280 engaged on seat bottom 34 and extending from right side portion 38 to left side portion 40. The rear edge of reinforcing strap 280 runs adjacent to the lower edge of seat back 36. The lower edge of rear strap portion 278 is adjacent to the lower edge of seat back 36 and is further adjacent to the rear edge of reinforcing strap 280. Rear strap portion 278 is engaged, such as by being sewn, to the seat back 36. Rear strap portion 278 may be formed by a square portion of the right hand portion of strap 252 and by a square portion of the left hand portion of strap 252, thereby defining a rectangular shape against the seat back 36. From the rear strap portion 278, each of the right hand portion and left hand portion of strap portion 252 runs free, without being engaged to seat back 36, to its respective length adjuster 268. It should be noted that rear strap portion 278 is disposed at a lower altitude than main buckle 244 when main buckle 244 is engaged about a child's tummy. Chair 12 includes a longitudinal midline running equidistance between right hand side portion 38 and left hand side portion 40. Rear strap portion 278 is on this midline, with the longitudinal center line of rear strap portion 278 being on such midline. With the location of rear strap portion 278, strap apparatus 218 runs obliquely from the child's lower back to the child's tummy.

Chair 12 can include an accessory holder 272 on the right hand side portion 38 of the chair 12. Holder 272 is formed of flexible mesh. Holder 272 is U-shaped. Holder 272 includes an open top and an open bottom. The sides of holder 272 are engaged, such as by being sewn, to the right side portion 38. Holder 272 is spaced from the upper oblique edge of right side portion 38. Holder 272 is spaced from each of the front and rear vertical edges of right side portion 38. Holder 272 is adjacent to the bottom edge of right side portion 38. Holder 272 includes an upper U-shaped stiffener 274 such that the mesh portion 276 holds the U-shape. Stiffener 274 may be rigid or semi-rigid. Holder 272 may hold, for instance, strap apparatus 218 when strap apparatus 218 is not being used. If desired, stiffener 274 may be replaced by a band 274 of elastic and mesh portion 276 may be elastic as well.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A connection between a tray and a leg of a chair, the leg having an upper portion, the tray having an underside, the connection comprising:

a) a first connector, the first connector engaged to the upper portion of the leg;

b) a second connector, the second connector being on the first connector;

c) a third connector, the third connector being on the underside of the tray;

d) an interlock between the second and third connectors;

e) a handle for disengaging the interlock from between the second and third connectors, the handle being one-piece and integral with the interlock;

f) a first resilient arm for keeping the interlock engaged between the second and third connectors and for automatically drawing the interlock back to an engaged position between the second and third connectors after the handle has been operated to disengage the interlock from between the second and third connectors, the first resilient arm being one-piece and integral with the handle and the interlock, the first resilient arm being engaged to the underside of the tray; and g) wherein each of the second and third connectors includes first, second, third, and fourth sides, wherein the first sides abut each other, wherein the second sides abut each other, wherein the third sides abut each other, and wherein the fourth sides abut each other such that side to side movement of the leg relative to the tray is minimized and such that front to rear movement of the leg relative to the tray is minimized.

2. The connection of claim 1, wherein the first connector is a female connector.

3. The connection of claim 1, wherein the first connector is cylindrical and receives the upper portion of the leg therein.

4. The connection of claim 1, wherein the second connector is a male connector.

5. The connection of claim 1, wherein the third connector is a female connector.

6. The connection of claim 1, wherein one of the second and third connectors is a male connector and wherein the other of the second and third connectors is a female connector.

7. The connection of claim 1, and further comprising a second resilient arm, wherein the handle includes a body, the body having a first side and a second side, the first resilient arm extending from the first side of the body, the second resilient arm extending from the second side of the body.

8. The connection of claim 1, wherein the tray includes a peripheral lip, wherein the peripheral lip defines a plane that separates an inside of the tray from an outside of the tray, and wherein the handle is on the inside of the tray and spaced from the plane when the interlock is engaged between the second and third connectors.

9. The connection of claim 1, wherein the tray includes a peripheral lip, wherein the peripheral lip defines a plane that separates an inside of the tray from an outside of the tray, and wherein the handle is adjacent to the plane when the interlock is disengaged from between the second and third connectors.

10. The connection of claim 1, wherein the tray includes a peripheral lip, wherein the peripheral lip defines a plane that separates an inside of the tray from an outside of the tray, wherein the handle is on the inside of the tray and spaced from the plane when the interlock is engaged between the second and third connectors, and wherein the handle is adjacent to the plane when the interlock is disengaged from between the second and third connectors.

11. The connection of claim 1, and further comprising a stop, the stop depending from the underside of the tray, wherein the handle includes a body, wherein the body includes a slot having an inner end and an outer end, the interlock being engaged between the second and third connectors when the stop abuts the inner end of the slot, the interlock being disengaged between the second and third connectors when the stop abuts the outer end of the slot.

12. A connection between a tray and a leg of a chair, the tray including a peripheral lip defining a plane that separates an inside of the tray from and outside of the tray, the connection comprising:

a) an interlock in the connection between the tray and the leg of the chair, the tray being locked to the chair when the interlock is in an engaged position, the tray being removable from the chair when the interlock is in a disengaged position; and b) a handle for sliding the interlock from the engaged position to the disengaged position, the handle being on the inside of the tray and spaced from the plane when the interlock is in the engaged position, and the handle being adjacent to the plane when the interlock is in the disengaged position.

13. The connection of claim 12, wherein the handle is one-piece and integral with the interlock.

14. The connection of claim 12, and further comprising the tray, the peripheral lip of the tray having an opening adjacent to the handle such that the handle is visible to a caregiver.

15. A connection between a tray and a leg of a chair, the leg having an upper portion, the tray having an underside, the connection comprising:

a) a first connector, the first connector engaged to the upper portion of the leg;

b) a second connector, the second connector being on the first connector;

c) a third connector, the third connector being on the underside of the tray;

d) an interlock between the second and third connectors;

e) a handle for disengaging the interlock from between the second and third connectors, the handle being one-piece and integral with the interlock;

f) a first resilient arm for keeping the interlock engaged between the second and third connectors and for automatically drawing the interlock back to an engaged position between the second and third connectors after the handle has been operated to disengage the interlock from between the second and third connectors, the first resilient arm being one-piece and integral with the handle and the interlock, the first resilient arm being engaged to the underside of the tray; and g) wherein the tray includes a peripheral lip, wherein the peripheral lip defines a plane that separates an inside of the tray from an outside of the tray, and wherein the handle is on the inside of the tray and spaced from the plane when the interlock is engaged between the second and third connectors.

16. A connection between a tray and a leg of a chair, the leg having an upper portion, the tray having an underside, the connection comprising:

a) a first connector, the first connector engaged to the upper portion of the leg;

b) a second connector, the second connector being on the first connector;

c) a third connector, the third connector being on the underside of the tray;

d) an interlock between the second and third connectors;

e) a handle for disengaging the interlock from between the second and third connectors, the handle being one-piece and integral with the interlock;

f) a first resilient arm for keeping the interlock engaged between the second and third connectors and for automatically drawing the interlock back to an engaged position between the second and third connectors after the handle has been operated to disengage the interlock from between the second and third connectors, the first resilient arm being one-piece and integral with the handle and the interlock, the first resilient arm being engaged to the underside of the tray; and g) wherein the tray includes a peripheral lip, wherein the peripheral lip defines a plane that separates an inside of the tray from an outside of the tray, wherein the handle is on the inside of the tray and spaced from the plane when the interlock is engaged between the second and third connectors, and wherein the handle is adjacent to the plane when the interlock is disengaged from between the second and third connectors.

17. A connection between a tray and a leg of a chair, the leg having an upper portion, the tray having an underside, the connection comprising:

a) a first connector, the first connector engaged to the upper portion of the leg;

b) a second connector, the second connector being on the first connector;

c) a third connector, the third connector being on the underside of the tray;

d) an interlock between the second and third connectors;

e) a handle for disengaging the interlock from between the second and third connectors, the handle being one-piece and integral with the interlock;

f) a first resilient arm for keeping the interlock engaged between the second and third connectors and for automatically drawing the interlock back to an engaged position between the second and third connectors after the handle has been operated to disengage the interlock from between the second and third connectors, the first resilient arm being one-piece and integral with the handle and the interlock, the first resilient arm being engaged to the underside of the tray; and g) a stop, the stop depending from the underside of the tray, wherein the handle includes a body, wherein the body includes a slot having an inner end and an outer end, the interlock being engaged between the second and third connectors when the stop abuts the inner end of the slot, the interlock being disengaged between the second and third connectors when the stop abuts the outer end of the slot.

* * * * *